US008053156B2

(12) United States Patent
Abe et al.

(10) Patent No.: US 8,053,156 B2
(45) Date of Patent: Nov. 8, 2011

(54) TONER, AND TONER PRODUCTION PROCESS

(75) Inventors: Koji Abe, Numazu (JP); Satoshi Handa, Suntoh-gun (JP); Shinya Yachi, Mishima (JP); Kazumi Yoshizaki, Suntoh-gun (JP); Emi Tosaka, Suntoh-gun (JP); Yasuhiro Hashimoto, Mishima (JP); Yushi Mikuriya, Mishima (JP); Hitoshi Itabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1018 days.

(21) Appl. No.: 11/912,650

(22) PCT Filed: Nov. 22, 2005

(86) PCT No.: PCT/JP2005/021924

§ 371 (c)(1),
(2), (4) Date: Oct. 25, 2007

(87) PCT Pub. No.: WO2007/004317

PCT Pub. Date: Jan. 11, 2007

(65) Prior Publication Data

US 2009/0035688 A1 Feb. 5, 2009

(30) Foreign Application Priority Data

Jun. 30, 2005 (JP) ..... 2005-192196

(51) Int. Cl.
*G03G 9/087* (2006.01)

(52) U.S. Cl. ..... 430/110.3; 430/109.3; 430/111.4; 430/137.17

(58) Field of Classification Search ..... 430/111.4, 430/109.3, 110.3, 137.17
See application file for complete search history.

(56) References Cited

U.S. PATENT DOCUMENTS

| | | | | |
|---|---|---|---|---|
| 5,635,325 | A | 6/1997 | Inaba et al. | |
| 5,679,490 | A | 10/1997 | Yachi et al. | 430/109.4 |
| 5,773,185 | A | 6/1998 | Yachi et al. | |
| 5,795,694 | A | 8/1998 | Uchiyama et al. | |
| 5,863,697 | A | 1/1999 | Uchiyama et al. | |
| 5,948,584 | A | 9/1999 | Hashimoto et al. | |
| 5,998,080 | A | 12/1999 | Ohno et al. | |
| 6,013,406 | A * | 1/2000 | Moriki et al. | 430/108.22 |
| 6,051,350 | A | 4/2000 | Inaba et al. | 430/45.54 |
| 6,177,223 | B1 | 1/2001 | Hashimoto et al. | |
| 6,203,958 | B1 | 3/2001 | Oya et al. | |
| 6,337,169 | B1 | 1/2002 | Hashimoto et al. | |
| 6,458,502 | B1 | 10/2002 | Nakamura et al. | 430/137.17 |
| 6,569,589 | B2 | 5/2003 | Inaba et al. | 430/108.22 |
| 6,632,577 | B2 | 10/2003 | Akashi et al. | |
| 7,112,393 | B2 | 9/2006 | Komoto et al. | 430/108.5 |
| 7,300,737 | B2 | 11/2007 | Ayaki et al. | 430/137.15 |
| 2007/0212631 | A1 | 9/2007 | Abe et al. | 430/109.3 |
| 2007/0259283 | A1 | 11/2007 | Abe et al. | 430/109.3 |

FOREIGN PATENT DOCUMENTS

| | | | |
|---|---|---|---|
| CN | 1117600 | A | 2/1996 |
| EP | 0470479 | | 7/1990 |
| EP | 0745906 | | 5/1996 |
| EP | 0965891 | | 6/1999 |
| JP | 7-117774 | | 12/1995 |
| JP | 2630972 | | 4/1997 |
| JP | 10-333359 | | 12/1998 |
| JP | 2000-347454 | A | 12/2000 |
| JP | 2002-006553 | | 1/2002 |
| JP | 2002-278137 | | 9/2002 |
| JP | 2003-241420 | | 8/2003 |
| JP | 2005-165162 | | 6/2005 |
| JP | 2005-181489 | | 7/2005 |

OTHER PUBLICATIONS

Korean Office Action issued in the counterpart Application No. 10-2008-7002536, dated Jan. 27, 2010—5 pages.

* cited by examiner

*Primary Examiner* — Janis L Dote
(74) *Attorney, Agent, or Firm* — Fitzpatrick, Cella, Harper & Scinto

(57) ABSTRACT

In a chart of molecular weight distribution measured of a toner, i) the toner has a main peak in the region of molecular weight of 16,000 to 60,000, and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) satisfy a specific proportion. The toner has a weight-average molecular weight (Mw) of 15,000 to 80,000, and, in an endothermic chart, i) the toner has an endothermic main peak in the range of 40 to 130° C., and ii) the calorimetric integral value represented by the peak area of the endothermic main peak is 10 to 35 J per 1 g of the toner.

17 Claims, 4 Drawing Sheets

TONER, AND TONER PRODUCTION PROCESS

TECHNICAL FIELD

This invention relates to a toner for developing electrostatic latent images in image forming processes such as electrophotography and electrostatic printing, or a toner for a toner jet system, and relates to a process for producing the toner.

BACKGROUND ART

Image forming processes are available in which, in order that electric or magnetic latent images on a recording member are made into visible images, the latent images are rendered visible by the used of a toner. As what is typical among these, it may include an electrophotographic process. In this electrophotographic process, first a latent image is electrically formed on a photosensitive member by various means, and subsequently the latent image is developed by the use of a toner to form a toner image. Thereafter, the toner image is transferring to a transfer material such as paper as occasion calls, and then the toner image is fixed to the transfer material by a fixing means such as heat, pressure, heat-and-pressure or solvent vapor, thus an image is obtained.

A heat roller fixing method or a film fixing method is a method in which toner images held on a fixing medium sheet (a sheet to which toner images are to be fixed) is fixed thereto by making them pass a heat roller or a fixing film in contact therewith. In this fixing method, the surface of the heat roller or fixing film and the toner on the fixing medium sheet come into contact with each other, and hence a very good heat efficiency is achievable when the toner is fused onto the fixing medium sheet. This enables performance of rapid fixing, and is very good for electrophotographic apparatus. In this fixing method, F however, since the toner comes into contact with the surface of the heat roller or fixing film in a molten state, part of the toner adheres to the surface of the heat roller or fixing film. Hence, an offset phenomenon in which the toner having adhered to the surface of the heat roller or fixing film is again transferred to a next fixing medium sheet may occur to contaminate the fixing medium sheet.

Taking account of recent demands for making apparatus compact, light-weight, energy-savable and highly reliable, such demands can not completely be met unless the performance of toners such as fixing performance and anti-offset properties is further improved. Such improvement is difficult to achieve unless the toners are further improved.

Japanese Patent Application Laid-open No. 2002-6553 discloses a toner which contains a low-molecular weight resin having a peak or a shoulder in a specific molecular weight region and a high-molecular weight resin having a peak or a shoulder in a specific molecular weight region, and also has a polyolefin type wax.

Japanese Patent No. 2630972 also discloses a toner in which the molecular weight distribution of THF-soluble matter as measured by GPC and the glass transition points of a binder resin and a toner have been prescribed.

Japanese Patent Application Laid-open No. H10-333359 still also disclose a toner which has prescribed specific molecular weight distribution and weight-average molecular weight.

However, it is desired to provide a toner having achieved more low-temperature fixing performance and higher glossiness than the toners disclosed in the above patent publications.

DISCLOSURE OF INVENTION

An object of the present invention is to provide a toner having settled the above subject.

Stated more specifically, it is to provide a toner which has superior low-temperature fixing performance and anti-offset properties, has a broad fixing temperature range, can obtain fixed images with a high gloss at the time of fixing, and can form toner images with a high image quality.

As a result of extensive studies made repeatedly, the present inventors have come able to settle the above subject by making a toner constituted as described below. That is, they have discovered that the toner which has superior low-temperature fixing performance and anti-offset properties, has a broad fixing temperature range, can obtain fixed images with a high gloss at the time of fixing and can form toner images with a high image quality can be obtained by making the toner constituted as described below. Thus, they have accomplished the present invention.

The present invention is concerned with a toner having toner particles containing at least a binder resin, a colorant and a wax, wherein;

in a chart of molecular weight distribution measured by gel permeation chromatography (GPC) of tetrahydrofuran (THF)-soluble matter of the toner;

i) the toner has a main peak in the region of molecular weight of from 16,000 to 60,000; and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) fulfill the following condition:

$$H(4000):H(15000):H(M1)=(0.10 \text{ to } 0.95):(0.20 \text{ to } 0.90):1.00;$$

the THF-soluble matter of the toner has a weight-average molecular weight (Mw) of from 15,000 to 80,000 as measured by GPC; and in an endothermic chart as measured by differential scanning calorimetry (DSC);

i) the toner has an endothermic main peak in the range of from 40 to 130° C.; and ii) the calorimetric integral value represented by the peak area of the endothermic main peak is from 10 to 35 J per 1 g of the toner.

The present invention is also concerned with a process for producing a toner; the process comprising producing toner particles through at least a granulation step of dispersing a polymerizable monomer composition having at least a polymerizable monomer, a colorant, a wax and a low-molecular weight resin, in an aqueous medium to produce droplets of the polymerizable monomer composition, and a polymerization step of polymerizing the polymerizable monomer composition present in the droplets;

the toner having toner particles containing at least a binder resin, the colorant and the wax, wherein;

in a chart of molecular weight distribution measured by gel permeation chromatography (GPC) of tetrahydrofuran (THF)-soluble matter of the toner;

i) the toner has a main peak in the region of molecular weight of from 16,000 to 60,000; and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) fulfill the following condition:

$$H(4000):H(15000):H(M1)=(0.10 \text{ to } 0.95):(0.20 \text{ to } 0.90):1.00;$$

the THF-soluble matter of the toner has a weight-average molecular weight (Mw) of from 15,000 to 80,000 as measured by GPC; and in an endothermic chart as measured by differential scanning calorimetry (DSC);

i) the toner has an endothermic main peak in the range of from 40 to 130° C.; and ii) the calorimetric integral value represented by the peak area of the endothermic main peak is from 10 to 35 J per 1 g of the toner.

BEST MODE FOR CARRYING OUT THE INVENTION

Figure 1:
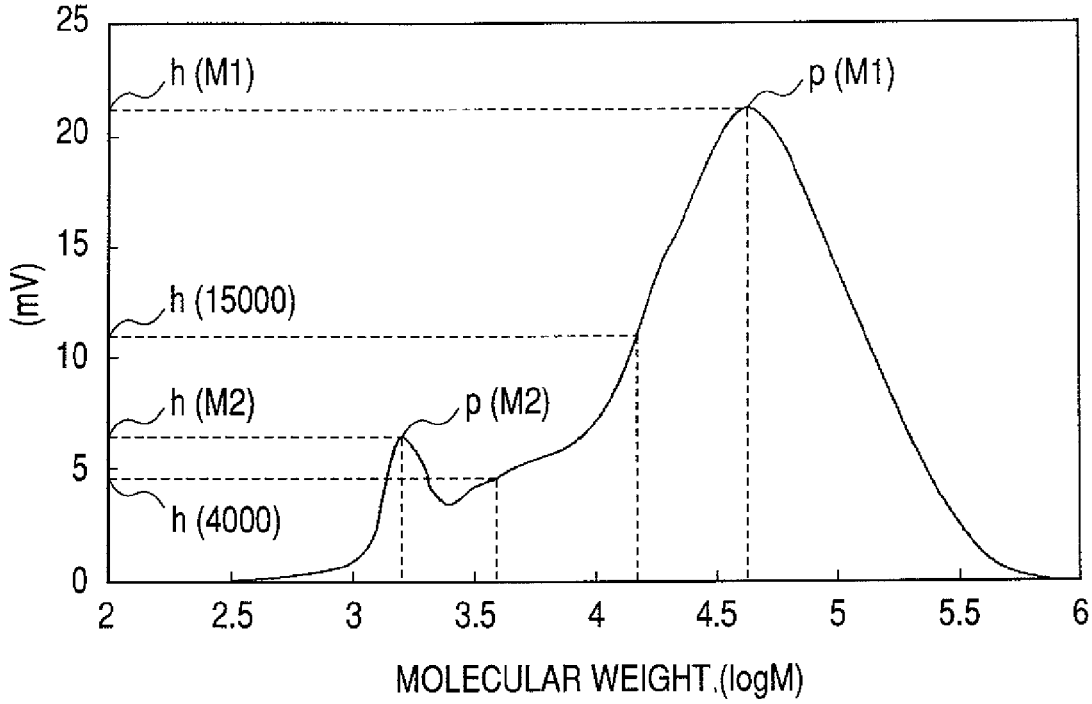
FIG. 1 shows an example of a chart of molecular weight distribution measured by GPC of THF-soluble matter of a toner.

The present invention makes it able to provide the toner which has superior low-temperature fixing performance and anti-offset properties, has a broad fixing temperature range, can obtain fixed images with a high gloss at the time of fixing, and can form toner images with a high image quality.

The present invention is described below in detail.

As summarized above, the toner of the present invention is a toner having toner particles containing at least a binder resin, a colorant and a wax, and is characterized in that;

in a chart of molecular weight distribution measured by gel permeation chromatography (GPC) of tetrahydrofuran (THF)-soluble matter of the toner;

i) the toner has a main peak in the region of molecular weight of from 16,000 to 60,000; and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) fulfill the following condition:

$$H(4000):H(15000):H(M1)=(0.10 \text{ to } 0.95):(0.20 \text{ to } 0.90):1.00;$$

the THF-soluble matter of the toner has a weight-average molecular weight (Mw) of from 15,000 to 80,000 as measured by GPC; and in an endothermic chart as measured by differential scanning calorimetry (DSC);

i) the toner has an endothermic main peak in the range of from 40 to 130° C.; and ii) the calorimetric integral value represented by the peak area of the endothermic main peak is from 10 to 35 J per 1 g of the toner.

The chart of molecular weight distribution of THF-soluble matter of the toner of the present invention may be obtained by making measurement with a GPC measuring instrument (HLC-8120 GPC, manufactured by Toso Corporation) under the following conditions.

Measuring Conditions

Columns: Combination of seven columns, Shodex GPC KF-801, Shodex GPC KF-802, Shodex GPC KF-803, Shodex GPC KF-804, Shodex GPC KF-805, Shodex GPC KF-806 and Shodex GPC KF-807 (available from Showa Denko K.K.;

diameter: 8.0 mm; length: 30 cm).

Temperature: 40° C.

Flow rate: 0.6 ml/min.

Detector: RI.

Sample concentration: 10 μl of a 0.15 wt. % sample.

The sample is prepared in the following way: A toner sample to be measured is put in tetrahydrofuran (THF), and this is left for 6 hours, followed by thorough shaking (until coalescent matter of the sample has disappeared), which is further left for at least 24 hours. Then, the solution having been passed through a sample-treating filter (pore size: 0.45 μm) is used as the sample for GPC measurement. As a calibration curve, used is a molecular weight calibration curve prepared from a monodisperse polystyrene standard sample.

Examples of charts of molecular weight distribution measured by GPC of THF-soluble matter of toners are shown in FIGS. 1 to 6.

Molecular weight distribution where, in a chart of molecular weight distribution measured by GPC of THF-soluble matter of the toner, the molecular weight at a main peak p(M1) is represented by M1 and the height at the M1 is represented by h(M1) (mV) is shown in FIG. 1. In FIG. 1, h(M2) shows the height at a sub-peak p(M2); h(4000), the height at a molecular weight of 4,000; and h(15000), the height at a molecular weight of 15,000.

Figure 2:
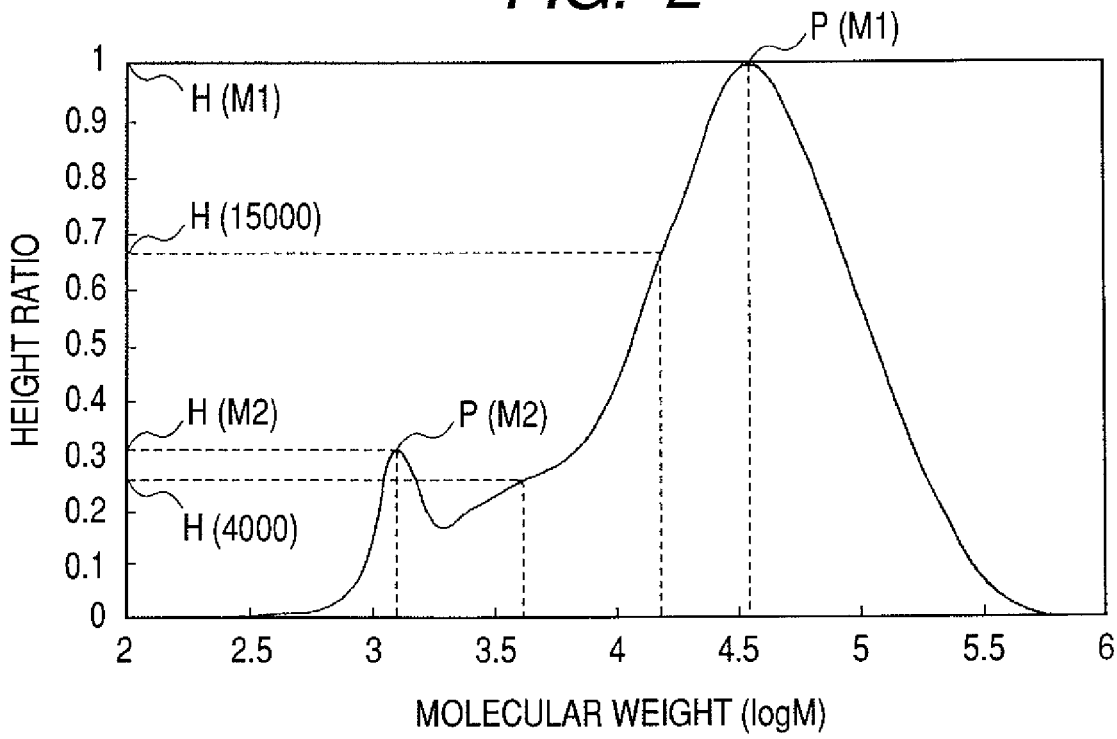
FIG. 2 shows an example of the chart of molecular weight distribution measured by GPC of THF-soluble matter of a toner as shown in FIG. 1, where the height at the main peak is regarded as 1.00.

A chart of molecular weight distribution where, in the chart of molecular weight distribution measured by GPC of THF-soluble matter of the toner as shown in FIG. 1, the heights are calculated as h(M1) (mV)=1.00 is shown in FIG. 2.

In FIG. 2, the height at a main peak P(M1) is represented by H(M1) (the molecular weight at the main peak is represented by M1), and the height at a sub-peak P(M2) is represented by H(M2) (the molecular weight at the sub-peak is represented by M2). Also, in FIG. 2, the height at a molecular weight of 4,000 is represented by H(4000), and the height at a molecular weight of 15,000 by H(15000). As shown in FIG. 2, the toner of the present invention has the main peak in the region of molecular weight of from 16,000 to 60,000.

Figure 3:
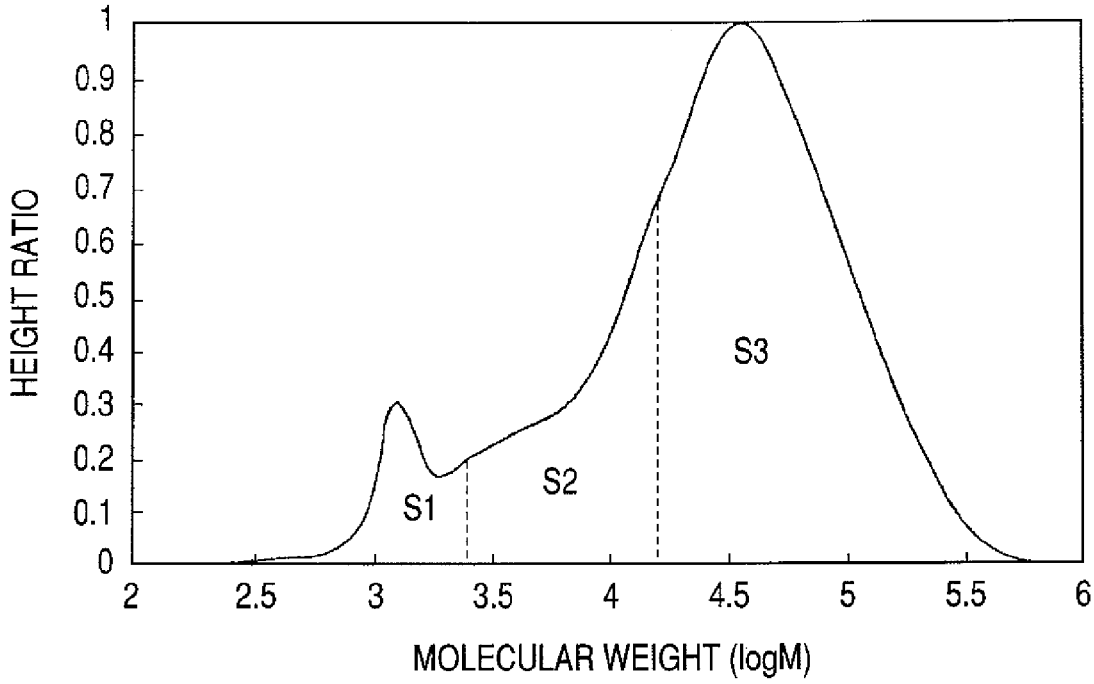
FIG. 3 shows the chart of molecular weight distribution measured by GPC of THF-soluble matter of a toner as shown in FIG. 1, where the height at the main peak is regarded as 1.00.

FIG. 3 also shows a chart of the same molecular weight distribution as that in FIG. 2. The integral value in the region of molecular weight of from 500 to 2,500 is represented by S1, the integral value in the region of molecular weight of from 2,500 to 15,000 by S2, and the integral value in the region of molecular weight of from 15,000 to 1,000,000 by S3.

Figure 4:
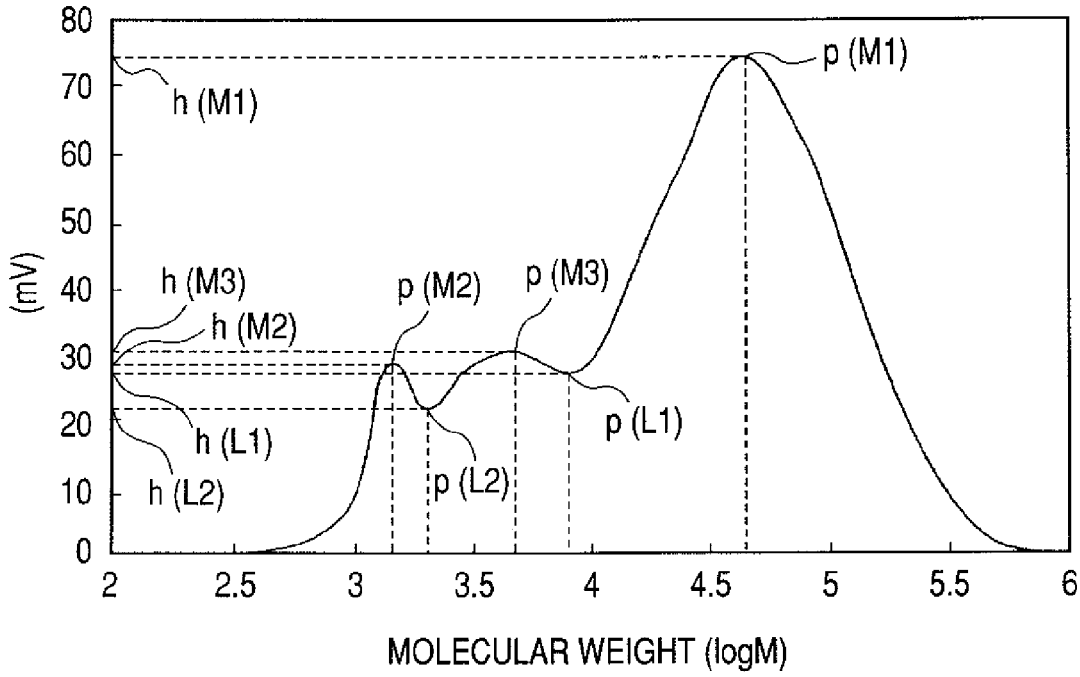
FIG. 4 shows an example of a chart of molecular weight distribution measured by GPC of THF-soluble matter of a toner.

FIG. 4 shows a chart of molecular weight distribution measured by GPC of THF-soluble matter of a toner where the toner has a maximum point p(M3) between a main peak p(M1) and a sub-peak p(M2). Also, the minimum value between the main peak p(M1) and the maximum value p(M3) is represented by p(L1), and the minimum value between the sub-peak p(M2) and the maximum value p(M3) by p(L2). In FIG. 4, h(M3) shows the height at the maximum value p(M3); h(L1), the height at the minimum value p(L1); and h(L2), the height at the minimum value p(L2).

Figure 5:
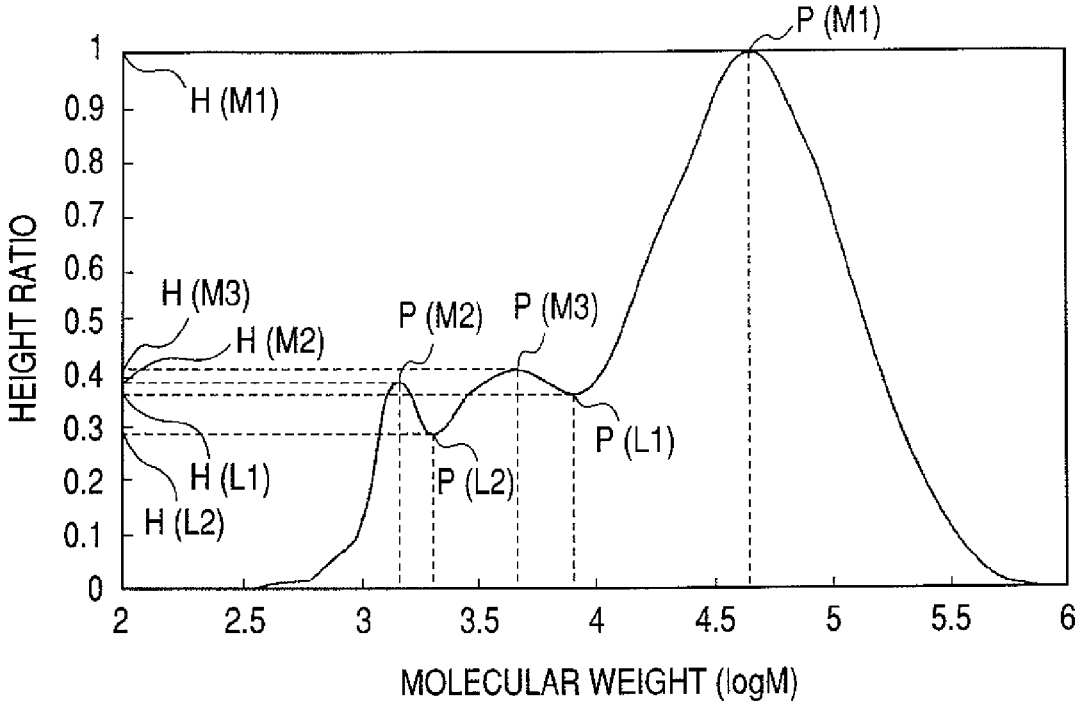
FIG. 5 shows the chart of molecular weight distribution measured by GPC of THF-soluble matter of a toner as shown in FIG. 4, where the height at the main peak is regarded as 1.00.

A chart of molecular weight distribution where, in the chart of molecular weight distribution measured by GPC of THF-soluble matter of the toner as shown in FIG. 4, the height h(M1) is calculated as h(M1) (mV)=1.00 is shown in FIG. 5.

In FIG. 5, the height at a main peak P(M1) is represented by H(M1) (the molecular weight at the main peak is represented by M1), and the height at a sub-peak P(M2) is represented by H(M2) (the molecular weight at the sub-peak is represented by M2). Also, in FIG. 5, the height at a maximum point P(M3) between the main peak P(M1) and the sub-peak P(M2) is represented by H(M3) [the molecular weight at the maximum point P(M3) is represented by M3 (M3>M2)]. Still also, in FIG. 5, the height at a molecular weight of 4,000 is represented by H(4000), and the height at a molecular weight of 15,000 by H(15000). Also, the minimum value between the main peak P(M1) and the maximum value P(M3) is represented by P(L1), and the minimum value between the sub-peak P(M2) and the maximum value P(M3) by P(L2). In FIG. 5, H(L1) shows the height at the minimum value P(L1); and H(L2), the height at the minimum value P(L2). As shown in FIG. 5, the toner of the present invention has the main peak in the region of molecular weight of from 16,000 to 60,000.

Figure 6:
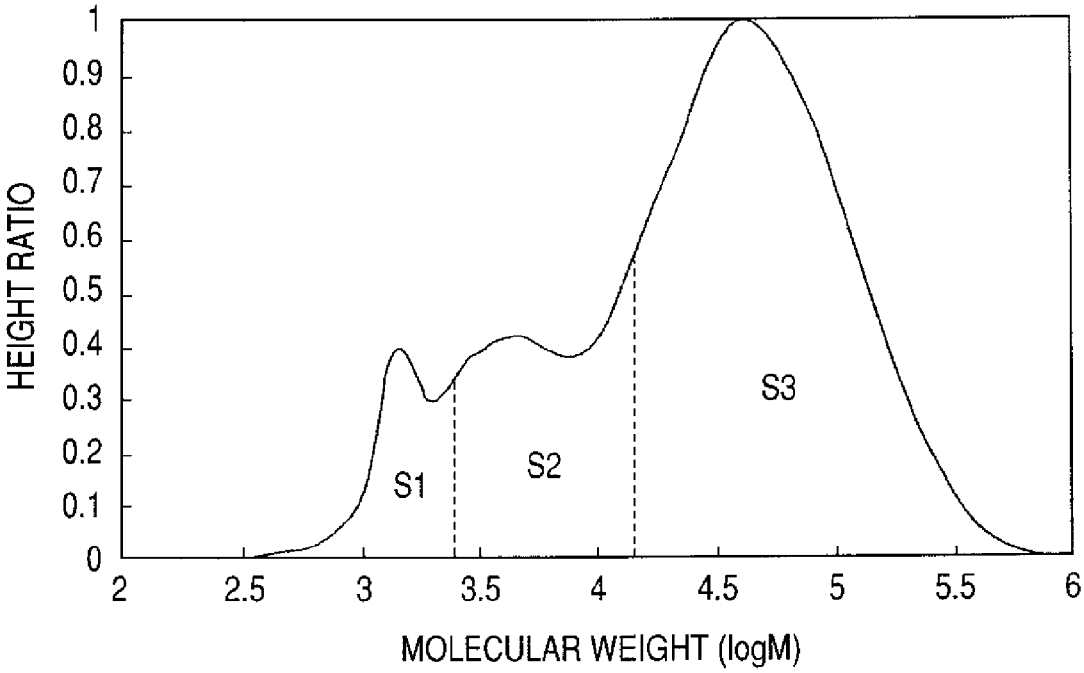
FIG. 6 shows the chart of molecular weight distribution measured by GPC of THF-soluble matter of a toner as shown in FIG. 4, where the height at the main peak is regarded as 1.00.

FIG. 6 also shows a chart of the same molecular weight distribution as that in FIG. 5. The integral value in the region of molecular weight of from 500 to 2,500 is represented by S1, the integral value in the region of molecular weight of from 2,500 to 15,000 by S2, and the integral value in the region of molecular weight of from 15,000 to 1,000,000 by S3.

The toner that satisfies the molecular weight distribution prescribed in the present invention as shown in FIGS. 1 to 6 has effects as stated below.

The toner, which contains a component having molecular weight in the region of from 4,000 to 15,000 in the chart of molecular weight distribution measured by GPC of THF-soluble matter of the toner, is effective in achieving low-temperature fixing performance, and has so small a melt viscosity that images with a high gloss can be obtained.

The toner, which contains a component having molecular weight in the region of from 15,000 to 60,000, may less cause the change in viscosity that is due to temperature changes, than the wax and the low-molecular weight polymer or low-molecular weight copolymer of less than 15,000 in molecular weight which are present in the toner, and hence can enjoy a broad fixable temperature range.

In the present invention, because of the features that the toner has a main peak in the region of molecular weight of from 16,000 to 60,000 and that the proportion of the heights at the respective molecular weights in that range is so prescribed as to be within the range stated in the present invention, components having specific molecular weights can be mixed in a well balanced state. In particular, the toner contains in a well balanced state the component having molecular weight in the region of from 4,000 to 15,000, and hence it may so quickly decrease in viscosity at the time of fixing as to be well effective in adhering to the paper and to make the wax quickly ooze out from toner particles to have a superior release effect. As the result, the toner can well be effective in achieving the low-temperature fixing performance. The toner also contains in a well balanced state the component having molecular weight in the region of from 15,000 to 60,000, and hence it so acts as to be more effective, on how the wax and the low-molecular weight polymer or low-molecular weight copolymer of less than 15,000 in molecular weight may soften and ooze out. This can make the toner well effective in achieving the low-temperature fixing performance and durability (running performance) and in broadening the fixable temperature range.

Here, if the H(4000) is less than 0.10 with respect to the H(M1) or the H(15000) is less than 0.20 with respect to the H(M1), the toner may have a poor low-temperature fixing performance, undesirably. In particular, the fact that the H(4000) is less than 0.10 with respect to the H(M1) means that the low-molecular weight component that is effective in improving gloss is in a small quantity, resulting in a low gloss. If on the other hand the H(4000) is more than 0.95 with respect to the H(M1) or the H(15000) is more than 0.90 with respect to the H(M1), the toner may have poor anti-offset properties, undesirably.

The toner of the present invention may also preferably have, in the chart of molecular weight distribution measured by GPC of THF-soluble matter in the toner, a sub-peak in addition to the main peak present in the region of molecular weight of from 16,000 to 60,000. The toner may further preferably have the sub-peak in the region of molecular weight of from 600 to 2,000. The toner, which contains a component having molecular weight in the region of from 600 to 2,000, enables further improvement in the low-temperature fixing performance. Inasmuch as the toner has a peak at the molecular weight M2 which is a very-low-molecular weight region, the toner can more effectively have a low melt viscosity at the time of low-temperature fixing to have a good low-temperature fixing performance, so that images with a high gloss can be obtained. Here, it is preferable that $H(M2)/H(M1) \geqq 0.10$. If $H(M2)/H(M1) < 0.10$, the toner may be less effective in achieving the low-temperature fixing performance.

In the present invention, it is also preferable that, in the chart of molecular weight distribution measured by GPC of THF-soluble matter in the toner, the integral value (S1) in the region of molecular weight of from 500 to 2,500 and the integral value (S2) in the region of molecular weight of from 2,500 to 15,000 and the integral value (S3) in the region of molecular weight of from 15,000 to 1,000,000 are in the ratio of S1:S2:S3=(0.15 to 0.95):1.00:(1.50 to 8.00). Inasmuch as S1:S2:S3=(0.15 to 0.95):1.00:(1.50 to 8.00), components contained in the toner are contained in a well balanced state, and hence the toner can achieve more improvement in the low-temperature fixing performance, the anti-offset properties and the formation of fixed images with a high gloss.

If S1 is less than 0.15 or S3 is more than 8.00 when S2 is 1.00, the toner may have a poor low-temperature fixing performance. If on the other hand S1 is more than 0.95 or S3 is less than 1.50 when S2 is 1.00, the toner may have poor anti-offset properties.

An example of more preferable molecular weight distribution in the present invention is shown in FIG. 4. In the present invention, the toner may preferably have, in the chart of molecular weight distribution measured by GPC of THF-soluble matter of the toner, a maximum point P(M3) in the region of molecular weight of from 2,500 or more to less than 15,000. Further, in the chart of molecular weight distribution measured by GPC of THF-soluble matter of the toner, where the height at the maximum point P(M3) is represented by H(M3) and the minimum point present between the maximum point P(M3) and the main peak is represented by P(L1), and where the height at the minimum point P(L1) is represented by H(L1), the H(M3), the H(L1) and the H(M1) may fulfill the following condition:

$$H(M3):H(L1):H(M1)=(0.10 \text{ to } 0.95):(0.20 \text{ to } 0.99):1.00.$$

This enables appropriate relaxation of mutual action between the resin component embraced in the region of molecular weight of from 2,500 or more to less than 15,000 and the resin component embraced in the region of molecular weight of from 15,000 or more (in particular, from 15,000 or more to less than 200,000). Hence, how the wax and the low-molecular weight polymer or low-molecular weight copolymer of less than 15,000 in molecular weight may soften and ooze out can effectively be improved, so that the toner can well be effective in achieving the low-temperature fixing performance and durability (running performance) and in broadening the fixable temperature range.

If the H(M3) is less than 0.10 or the H(L1) is more than 0.99 both with respect to the H(M1), the toner may have a poor low-temperature fixing performance, undesirably. If on the other hand the H(M3) is more than 0.95, the toner may have poor anti-offset properties, undesirably. Also, if the H(L1) is less than 0.20, the toner may have a small fixable temperature range, undesirably.

In an endothermic chart as measured by differential scanning calorimetry (DSC), the toner of the present invention also has an endothermic main peak in the range of from 40 to 130° C., and the calorimetric integral value Q represented by the peak area of the endothermic main peak is from 10 to 35 J per 1 g of the toner.

As described above, the toner may preferably be so constituted that it may have the endothermic main peak and have the main peak in the region of specific molecular weight and the proportion of the heights at specific molecular weights, H(4000), H(15000) and H(M1) may be within the stated range. This makes it able to obtain the desired high-performance toner. This is because, of the constitution prescribed in the present invention, the toner has an endothermic main peak in the range of from 40 to 130° C., and the calorimetric integral value Q represented by the peak area of the endothermic main peak is from 10 to 35 J per 1 g of the toner. This enables the toner to exhibit a good releasability even at the time of low-temperature fixing. Further, the wax appropriately relaxes the intermolecular force acting between polymer chains of the binder resin, and this can form a state in which the softening of toner that is due to the endothermism (absorption of heat) at the time of fixing and the hardening of resin that is due to the dissipation of heat of the toner are opportune. The calorimetric integral value Q represented by the peak area of the endothermic main peak may be controlled by appropriately selecting the type of the wax and its content. Incidentally, this endothermic main peak may preferably be in the range of from 50 to 110° C., and more preferably from 60 to 90° C. Also, the calorimetric integral value Q of the endothermic main peak may more preferably be from 15 to 35 J per 1 g of the toner.

Incidentally, if the calorimetric integral value Q of the endothermic main peak is less than 10 J per 1 g of the toner, the toner may have a poor fixing performance to make the fixed images have a low gloss, and also the fixing member and so forth can not be expected to be kept from being abraded or scratched. On the other hand, if the calorimetric integral value Q of the endothermic main peak is more than 35 J per 1 g of the toner, the wax may have so great a plastic effect to make the toner have poor anti-offset properties.

As the production process for producing the toner of the present invention, it may preferably be a process of producing toner particles directly in a medium (hereinafter also "polymerization process"), such as a suspension polymerization process, an interfacial polymerization process and a dispersion polymerization process. The toner produced by this polymerization process (hereinafter also "polymerization toner") has a high transfer performance because it has toner particles which are substantially uniformly spherical in shape and also it has charge quantity distribution which is relatively uniform. In particular, as the production process for producing the toner of the present invention, it may preferably be a suspension polymerization process among the above polymerization processes.

Then, the process is described below in regard to the suspension polymerization process.

In the present invention, the suspension polymerization process is a polymerization process which produces toner particles through at least at granulation step of dispersing a polymerizable monomer composition having at least a polymerizable monomer, a colorant, a wax and a low-molecular weight resin, in an aqueous medium to produce droplets of the polymerizable monomer composition, and a polymerization step of polymerizing the polymerizable monomer composition present in the droplets.

In particular, in the present invention, the toner particles may preferably be toner particles produced by the above suspension polymerization process. Also, the THF-soluble matter of the low-molecular weight resin may preferably have a weight-average molecular weight (Mw) of from 2,000 to 6,000 as determined by GPC, and this is preferable in view of low-temperature fixing performance and blocking resistance.

In the production of the toner of the present invention, for the purpose of improving shape of toner particles, dispersibility of materials, fixing performance or image characteristics, a resin may be added to the polymerizable monomer composition to carry out polymerization. For example, when a monomer component containing a hydrophilic functional group should be introduced into toner particles, which monomer component can not be used because it is water-soluble as the monomer and dissolves in an aqueous suspension to cause emulsion polymerization, it is done in the following way. That is, it may be used in the form of a copolymer such as a random copolymer, block copolymer or graft copolymer of the monomer component containing a hydrophilic functional group, with a vinyl compound such as styrene or ethylene. It may also be used in the form of a polycondensation product such as polyester or polyamide, or in the form of a polyaddition polymer such as polyether or polyimine, with the monomer component containing a hydrophilic functional group. Incidentally, the hydrophilic functional group may include an amino group, a carboxylic acid group, a hydroxyl group, a sulfonic acid group, a glycidyl group and a nitrile group.

Besides the foregoing, the low-molecular weight resin which may be added to the polymerizable monomer composition may include the following: Homopolymers of styrene or derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosins, modified rosins, terpene resins, phenolic resins, aliphatic or alicyclic hydrocarbon resins, and aromatic petroleum resins. Incidentally, the above low-molecular weight resin may be used alone or in the form of a mixture.

Of these low-molecular weight resins, preferred are low-molecular weight resins having a glass transition point of from 40 to 100° C. If the low-molecular weight resin has a glass transition point of less than 40° C., the whole toner particles may have a low strength to tend to cause a lowering of transfer performance or developing performance at the time of a many-sheet running test. A problem may further arise such that the toner particles mutually agglomerate in a high-temperature and high-humidity environment to cause a lowering of storage stability. On the other hand, if the resin has a glass transition point of more than 100° C., a problem of faulty fixing tends to arise.

In view of advantages that low-temperature fixing performance can be achieved and images with a high gloss can be obtained, the low-molecular weight resin may preferably have a glass transition point of from 40 to 70° C., and more preferably from 40 to 65° C.

The low-molecular weight resin may preferably be added in an amount of from 0.1 to 75 parts by weight based on 100 parts by weight of the binder resin in the toner particles. If it is added in an amount of less than 0.1 part by weight based on 100 parts by weight of the binder resin in the toner particles, the addition of the low-molecular weight resin can be less effective.

The toner of the present invention may preferably be a toner which have toner particles each having at least a core and a shell. In such toner particles, the shell is present as it covers the core. Such structure employed enables prevention of faulty charging or blocking in every environment, which may be caused where cores come separated out to toner particle surfaces. Also, more preferred are those in which a surface layer having a contrast different from the shell is further present on the surface of the shell. The presence of this surface layer enables more improvement in environmental stability, running performance and blocking resistance.

In the present invention, as a specific method for measuring the cross sections of such toner particles, the following method is available. First, the toner is well dispersed in a room temperature curable epoxy resin, and thereafter this is left in an environment of temperature 40° C. for 2 days to effect curing. The cured product obtained is cut with a microtome having a diamond cutter, to cut out thin-sliced samples. Next, using triruthenium tetraoxide and triosmium tetraoxide in combination, the sample slices are subjected to dying which proceeds from some difference in crystallinity, and further irradiated with electron rays, where the difference in contrast thereby produced that is due to electron density is photographed on a transmission electron microscope (TEM).

In the present invention, whether or not the toner particles have a core/shell structure may be judged on the basis of the results of observation on the transmission electron microscope, obtained according to the above measuring method. Here, in a sectional photograph in which the breadth of a particle comes to D4 plus-minus (D4×0.2) μm with respect to weight-average particle diameter D4 of the toner, a case in which the core is covered with the shell is judged that the former is enclosed by the latter. Cummuratively 100 or more particles are observed, and the proportion in which cores are enclosed by shells is found as enclosure percentage (% by number).

In the toner of the present invention, it is prescribed that the core/shell structure stands formed where the enclosure percentage of cores is in the range of from 60 to 100% by number. If the enclosure percentage of cores is less than 60% by number, the toner may have a low environmental stability or running stability because of an influence of cores standing uncovered to toner particle surfaces.

In the toner of the present invention, whether or not the surface layer present on the surface of the shell (hereinafter also "surface layer structure") is present may be judged on the basis of the results of observation on the transmission electron microscope, obtained according to the above measuring method. In the sectional photograph in which the breadth comes to D4 plus-minus (D4×0.2) μm with respect to weight-average particle diameter D4 of the toner, cummuratively 100 or more particles are observed and the proportion of toner particles having the surface layer structure is regarded as toner surface layer structure percentage (% by number). In the present invention, it is judged that the surface layer structure stands formed where the toner surface layer structure percentage is in the range of from 60 to 100% by number. If the toner surface layer structure percentage is less than 60% by number, the toner may have a low environmental stability or running stability.

In the present invention, the proportion the surface layer holds may preferably be from 0.5 to 80 area % on the basis of the surface area of a toner particle.

The material that constitutes the surface layer may preferably have a molecular-chain polar structure.

In the present invention, the molecular-chain polar structure is meant to be a molecular structure in which the atoms in the molecule are provided with the electron-density state of δ+ or δ− in a large number.

The molecule of a resin is constituted of two or more kinds of atoms, and its constituent atoms have a specific electronegativity. Its value greatly differs depending on the atoms. Because of this difference in electronegativity, electrons localize in the molecule. How they localize here differs depending on the kind, number and manner of combination of the constituent atoms, and the polarity of molecular chains changes.

What is preferable as the molecular-chain polar structure is a linkage structure formed by, e.g., condensation polymerization or addition polymerization. Stated specifically, it may include an ester linkage (—COO—), an ether linkage (—O—), an amide linkage (—CONH—), an imine linkage (—NH—), a urethane linkage (—NHCOO—) and a urea linkage (—NHCONH—).

For example, in an ether chain (—$CH_2O$—$CH_2$—) or the like, it is in a state that electrons on the carbon atoms are a little deficient (δ+), electrons on the oxygen atom are a little excess (δ−), and further a bond angle is formed at the oxygen atom as a vertex. When the molecular chain standing polarized in this way is in a large number, the molecule, i.e., the resin has a large polarity, and, when the molecular chain standing polarized is in a small number, a small polarity. Also, molecules composed of hydrocarbon commonly have a low polarity.

The feature that the surface layer has such a molecular-chain polar structure brings an improvement in charging stability. Also, where the toner particles are formed in a polar solvent as in an aqueous or hydrophilic medium, surface layers having the molecular-chain polar structure are formed more uniformly in the vicinities of toner particle surfaces. Hence, the toner is improved in charging stability in a high-temperature and high-humidity environment and a low-temperature and low-humidity environment, and running performance at the time of high-speed printing.

The material constituting the surface layer particularly preferably used in the present invention may include a polyester resin or derivatives thereof.

What is preferred as the polymerizable monomer usable in forming toner particles in the present invention may include the following vinyl type polymerizable monomers: Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic esters; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The shell is constituted of a vinyl monomer formed from any of these vinyl type polymerizable monomers, or a resin added. Of those formed from any of these vinyl type polymerizable monomers, styrene polymers, styrene-acrylic copolymers or styrene-methacrylic copolymers are preferred in view of an advantage that they can efficiently cover the wax which forms the inner part or central part.

As the material constituting the core of the toner particles in the present invention, a wax is preferred.

As a wax component usable in the toner of the present invention, it may include the following: Petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes such as polyethylene wax and polypropylene wax and derivatives thereof, and naturally occurring waxes such as carnauba wax and candelilla wax and derivatives thereof. The derivatives include oxides, block copolymers with vinyl monomers, graft modified products, higher aliphatic alcohols, fatty acids such as stearic acid and palmitic acid, or compounds thereof, acid amide waxes, ester waxes, ketones, hardened caster oil and derivatives thereof, vegetable waxes, animal waxes and silicone resins.

Ester waxes having at least one long-chain ester moiety having at least 10 carbon atoms as shown by the following formulas (1) to (6) are particularly preferred as being free from impairment of the transparency or the like required for OHP.

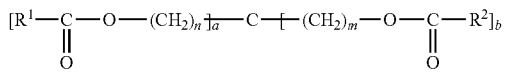

(1)

wherein a and b each represent an integer of 0 to 4, provided that a+b is 4; $R^1$ and $R^2$ each represent an organic group having 1 to 40 carbon atoms; and n and m each represent an integer of 0 to 15, provided that n and m are not 0 at the same time.

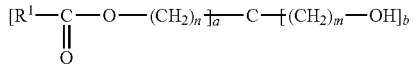

(2)

wherein a and b each represent an integer of 1 to 3, provided that a+b is 4; $R^1$ represents an organic group having 1 to 40 carbon atoms; and n and m each represent an integer of 0 to 15, provided that n and m are not 0 at the same time.

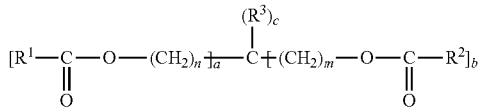

(3)

wherein a and b each represent an integer of 0 to 3, provided that a+b is 3 or less; $R^1$ and $R^2$ each represent an organic group having 1 to 40 carbon atoms, provided that a difference in the number of carbon atoms between $R^1$ and $R^2$ is 10 or more; $R^3$ represents an organic group having 1 or more carbon atoms; c is 2 or 3, and a+b+c is 4; and n and m each represent an integer of 0 to 15, provided that n and m are not 0 at the same time.

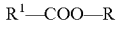

(4)

wherein $R^1$ and $R^2$ each represent a hydrocarbon group having 1 to 40 carbon atoms, and $R^1$ and $R^2$ may have the number of carbon atoms which is the same or different from each other.

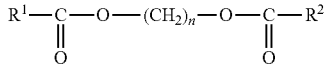

(5)

wherein $R^1$ and $R^2$ each represent a hydrocarbon group having 1 to 40 carbon atoms; n represents an integer of 2 to 20; and $R^1$ and $R^2$ may have the number of carbon atoms which is the same or different from each other.

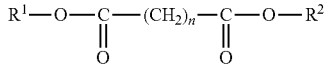

(6)

wherein $R^1$ and $R^2$ each represent a hydrocarbon group having 1 to 40 carbon atoms; n represents an integer of 2 to 20; and $R^1$ and $R^2$ may have the number of carbon atoms which is the same or different from each other.

As to molecular weight of the wax, the wax may preferably have a weight-average molecular weight (Mw) of from 300 to 1,500. If the wax has an Mw less than 300, it tends to come bare to the toner particle surfaces, and if it has an Mw more than 1,500, the toner may have a low low-temperature fixing performance. In particular, those having an Mw within the range of from 400 to 1,250 are preferred. Further, when the ratio of weight-average molecular weight to number-average molecular weight (Mw/Mn) is 1.5 or less, the wax can have a sharper peak of the DSC endothermic curve, so that the mechanical strength of the toner particles at room temperature is improved, and especially good toner performances can be obtained, showing sharp melt characteristics at the time of fixing.

Specific examples of the ester wax may include the following compounds.

1) $CH_3(CH_2)_20COO(CH_2)_{21}CH_3$

2) $CH_3(CH_2)_{17}COO(CH_2)_9OOC(CH_2)_{17}CH_3$

3) $CH_3(CH_2)_{17}COO(CH_2)_{18}COO(CH_2)_{17}CH_3$

In recent years, full-color both-side images have become more needed. In forming both-side images, there is a possibility that toner images on a transfer material which have first been formed on the surface again pass the heating part of a fixing assembly also when images are next formed on the back. It is necessary to sufficiently take account of high-temperature anti-offset properties of the toner against fixed images in that case. Stated specifically, the wax may preferably be added to the interiors of toner particles in an amount of 2 to 30% by weight. If it is added in an amount of less than 2% by weight, the toner may have low high-temperature anti-offset properties, and further the images on the back side may show an offset phenomenon at the time of fixing for both-side images. If it is added in an amount of more than 30% by weight, the toner particles tend to coalesce at the time of granulation when produced by polymerization, and those having a broad particle size distribution tend to be formed.

The toner of the present invention may preferably have, in its particles of 3 μm or more in diameter, an average circularity of from 0.970 to 1.000 and a mode circularity of from 0.98 to 1.00.

Here, the "circularity" referred to in the present invention is used as a simple method for expressing the shape of particles quantitatively, and is determined by measurement with a flow type particle image analyzer FPIA-2100, manufactured by Sysmex Corporation. The value found according to the following expression is defined as the circularity.

$$\text{Circularity } a = L_0/L$$

$L_0$: The circumferential length of a circle having the same projected area as a particle image.

L: The circumferential length of a particle image.

($L_0$ represents the circumferential length of a circle having the same projected area as a particle image, and L represents the circumferential length of a particle projected image.)

The circularity referred to in the present invention is an index showing the degree of surface unevenness of toner particles. The circularity is indicated as 1.00 when the toner particles have perfectly spherical particle shapes. The more complicate the surface shapes of the toner particles are, the smaller the value of circularity is.

The toner having an average circularity of from 0.970 to 1.000 is preferred in view of its very good transfer performance. This is considered due to the fact that the area of contact between the toner particles and the photosensitive member can be so small as to lower the adherence force of toner particles on photosensitive member that is ascribable to mirror force or van der Waals force. Accordingly, the use of such a toner can achieve so high a transfer efficiency as to reduce transfer residual toner greatly, and hence the toner at the part of pressure contact between a charging member and a photosensitive member can be in a very small quantity, so that the toner can be prevented from melt-adhering and images defects can remarkably be kept from occurring, as so considered.

These effects are more remarkably brought out in an image forming process having a contact transfer step, which tends to cause blank areas caused by poor transfer.

The toner of the present invention may be produced by a pulverization process. However, the toner obtained by such pulverization commonly have an amorphous shape, and hence any mechanical and thermal or any special treatment must be carried out in many cases in order that the toner obtained by pulverization is made to have the average circularity of from 0.970 to 1.000.

The fact that the toner also has a mode circularity of from 0.98 to 1.00 in circularity distribution of the toner means that most toner particles have a shape close to true spheres. In this case, the adherence force of toner particles on photosensitive member that is ascribable to mirror force or van der Waals force lowers more remarkably to achieve a very high transfer efficiency favorably.

Here, the "mode circularity" is like that which is as follows. First, circularities of from 0.40 to 1.00 are divided into 61 ranges at intervals of 0.01 in such ranges as 0.40 or more to less than 0.41, 0.41 or more to less than 0.42 . . . , 0.99 or more to less than 1.00, and 1.00. Then, the circularities of particles measured are allotted to the respective division ranges, and the circularity in a division range where the value of frequency comes maximum in the circularity frequency distribution is referred to as the mode circularity.

In the present invention, for the purpose of controlling chargeability of the toner, a charge control agent may preferably previously be added to the interiors of toner particles.

As the charge control agent, those almost free of polymerization inhibitory action and aqueous-phase transfer properties are preferred among known agents. It may include, e.g., as positive charge control agents, Nigrosine dyes, triphenylmethane dyes, quaternary ammonium salts, guanidine derivatives, imidazole derivatives and amine compounds. As negative charge control agents, it may include metal-containing salicylic acid copolymers, metal-containing monoazo dye compounds, urea derivatives, styrene-acrylic acid copolymers and styrene-methacrylic acid copolymers.

Any of these charge control agents may be added in an amount of from 0.1 to 10% by weight based on the weight of the binder resin or polymerizable monomers.

A polymerization initiator used when the toner particles are produced by polymerization, it may include the following: Azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide. Any of these polymerization initiators may preferably be added in an amount of from 0.5 to 20% by weight based on the weight of the polymerizable monomer, and may be used alone or in combination.

In order to control the molecular weight of the binder resin in the toner particles, a chain transfer agent may also be added. It may preferably be added in an amount of from 0.001 to 15% by weight based on the weight of the polymerizable monomer.

In order to control the molecular weight of the binder resin in the toner particles, a cross-linking agent may also be added. For example, as a cross-linkable monomer, it may include, as bifunctional cross-linking agents, the following: Divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates (MANDA; available from Nippon Kayaku Co., Ltd.), and the above diacrylates each acrylate moiety of which has been replaced with methacrylate.

As a polyfunctional cross-linkable monomer, it may include the following: Pentaerythritol triacrylate, trimethylolethane triacrylate, trimethylolpropane triacrylate, tetramethylolmethane tetraacrylate, oligoester acrylate, and methacrylates of these, and also 2,2-bis(4-methacyloxypolyethoxyphenyl)propane, diacrylphthalate, triallylcyanurate, triallylisocyanurate, triallyltrimellitate and diaryl chlorendate.

The cross-linking agent may preferably be added in an amount of 0.001 to 15% by weight based on the weight of the polymerizable monomer.

In the case of an aqueous dispersion medium, as a dispersion stabilizer for the particles of the polymerizable monomer composition, it may include the following: Fine powders of inorganic compounds such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

In the present invention, for the purpose of providing various properties, various additives shown below may be incorporated in addition to the foregoing. Such additives may preferably have a particle diameter of not more than 1/10 of the weight-average diameter of the toner particles in view of their durability when added to the toner particles. This particle diameter of the additives is meant to be an average particle diameter measured using an electron microscope by observing surfaces of toner particles. As these properties-providing additives, for example, the following may be used.

1) Fluidity-providing agents: Metal oxides (e.g., silicon oxide, aluminum oxide and titanium oxide), carbon black, and carbon fluoride. These may more preferably those having been subjected to hydrophobic treatment.

2) Abrasives: Metal oxides (e.g., cerium oxide, aluminum oxide, magnesium oxide and chromium oxide), nitrides (e.g., silicon nitride), carbides (e.g., silicon carbide), and metal salts (e.g., strontium titanate, calcium sulfate, barium sulfate and calcium carbonate).

3) Lubricants: Fluorine resin powders (e.g., vinylidene fluoride and polytetrafluoroethylene), and fatty acid metal salts (e.g., zinc stearate and calcium stearate).

4) Charge controlling particles: Metal oxides (e.g., tin oxide, titanium oxide, zinc oxide, silicon oxide and aluminum oxide), and carbon black.

Any of these additives may preferably be used in an amount of from 0.1 to 10 parts by weight, and more preferably from 0.1 to 5 parts by weight, based on 100 parts by weight of the toner particles. These additives may be used alone or in combination of two or more.

The toner of the present invention may preferably have a weight-average particle diameter D4 of from 2.0 to 12.0 μm, may more preferably have a weight-average particle diameter of from 4.0 to 9.0 μm, and may still more preferably have a weight-average particle diameter of from 5.0 to 8.0 μm.

The toner of the present invention may have a glass transition point (Tg) of from 40 to 100° C., preferably from 40 to 80° C., and more preferably from 45 to 70° C. If it has a glass transition point of less than 40° C., the toner may have a low blocking resistance. If it has a glass transition point of more than 100° C., the toner may have low low-temperature anti-offset properties and a low transparency of films for over head projectors.

THF-insoluble matter in the toner may preferably be in a content of from 0 to 90% by weight, more preferably from 1 to 20% by weight, and most preferably from 2 to 10% by weight.

The content of the THF-insoluble matter shows the weight proportion of an ultra-high-molecular weight polymer component (substantially a cross-linked polymer) of the resin, having come insoluble in THF solvent. The THF-insoluble matter is defined to be a value measured in the following way.

The toner is weighed in an amount of about 1 g ($W_1$ g), which is then put into a cylindrical filter paper (e.g., No. 86R, available from Toyo Roshi K.K.) and this is set on a Soxhlet extractor. Then, extraction is carried out for 6 hours using from 100 to 200 ml of THF as the THF solvent, and the soluble component extracted is evaporated, followed by vacuum drying at 100° C. for several hours, where the THF-soluble component is weighed ($W_2$ g). The THF-insoluble matter of the toner is calculated from the following expression.

$$THF\text{-insoluble matter(\% by weight)}=(W_1-W_2)/W_1\times 100.$$

The tetrahydrofuran (THF)-soluble matter in the toner of the present invention has a weight-average molecular weight (Mw) of from 15,000 to 80,000 as measured by gel permeation chromatography (GPC). Such a toner well brings out environmental stability and running stability. Further, the tetrahydrofuran (THF)-soluble matter in the toner may preferably have a weight-average molecular weight of from 20,000 to 50,000 as measured by gel permeation chromatography (GPC). If the THF-soluble matter in the toner has a weight-average molecular weight of less than 15,000 as measured by GPC, the toner tends to have a poor blocking resistance or running performance. If it has a weight-average molecular weight of more than 80,000, it is difficult to achieve low-temperature fixing performance and obtain images with a high gloss.

The tetrahydrofuran (THF)-soluble matter in the toner of the present invention may also preferably have a ratio of weight-average molecular weight to number-average molecular weight as measured by gel permeation chromatography (GPC), Mw/Mn, of from 10 to 100. If it has an Mw/Mn of less than 10, the toner may have a narrow fixable temperature range. If it has an Mw/Mn of more than 100, the toner may have a poor low-temperature fixing performance.

In the present invention, as a dispersion stabilizer used when the toner is produced by polymerization, it may include the following: Organic compounds such as polyvinyl alcohol, gelatin, methyl cellulose, methyl hydroxypropyl cellulose, ethyl cellulose, carboxymethyl cellulose sodium salt, polyacrylic acid and salts thereof, polymethacrylic acid and salts thereof, and starch. Any of these dispersion stabilizers may preferably be used in an amount of from 0.2 to 20 parts by weight based on 100 parts by weight of the polymerizable monomer.

Of the dispersion stabilizers, when an inorganic compound is used, those commercially available may be used as they are. In order to obtain fine particles, however, fine particles of an inorganic compound may be formed in an aqueous dispersion medium. For example, in the case of calcium phosphate, an aqueous sodium phosphate solution and an aqueous calcium chloride solution may be mixed under high-speed agitation.

In order to finely dispersing the dispersion stabilizer, a surface-active agent may be used in an amount of from 0.001 to 0.1 part by weight based on 100 parts by weight of the polymerizable monomer. This is to accelerate the initial action of the above dispersion stabilizer. As the surface-active agent, it may include the following: Sodium dodecylbenzenesulfate, sodium tetradecylsulfate, sodium pentadecylsulfate, sodium octylsulfate, sodium oleate, sodium laurate, sodium octylate, sodium stearate and calcium oleate.

As the colorant used in the present invention, known colorants may be used.

For example, black pigments may include the following: Carbon black, aniline black, non-magnetic ferrite and magnetite.

Yellow pigments may include the following: Yellow iron oxide, naples yellow, Naphthol Yellow S, Hanza Yellow G, Hanza Yellow 10G, Benzidine Yellow G, Benzidine Yellow GR, Quinoline Yellow Lake, Permanent Yellow NCG, and Tartrazine Yellow Lake.

Orange pigments may include the following: Permanent Orange GTR, Pyrazolone Orange, Vulcan Fast Orange, Benzidine Orange G, Indanthrene Brilliant Orange RK, and Indanthrene Brilliant Orange GK.

Red pigments may include the following: Iron oxide red, Permanent Red 4R, Lithol Red, Pyrazolone Red, Watchung Red calcium salt, Lake Red C, Lake Red D, Brilliant Carmine 6B, Brilliant Carmine 3B, Eosine Lake, Rhodamine Lake B, and Alizarine Lake.

Blue pigments may include the following: Alkali Blue Lake, Victoria Blue Lake, Phthalocyanine Blue, Metal-free Phthalocyanine Blue, Phthalocyanine Blue partial chloride, Fast Sky Blue, and Indanthrene Blue BG.

Violet pigments may include the following: Fast Violet B, and Methyl Violet Lake.

Green pigments may include the following: Pigment Green B, Malachite Green Lake, and Final Yellow Green G.

White pigments may include zinc white, titanium oxide, antimony white, and zinc sulfide.

Any of these pigments may be used alone, in the form of a mixture, or in the state of a solid solution.

The colorant used in the present invention is selected taking account of hue angle, chroma, brightness, weatherability, OHP transparency and dispersibility in toner particles. The colorant may usually be added in an amount of from 1 to 20 parts by weight based on 100 parts by weight of the binder resin. In the case when a magnetic material or a metal oxide is used as the black colorant, it may be used in an amount of from 20 to 150 parts by weight based on 100 parts by weight of the binder resin, which is different from the amount of other colorant.

In the present invention, in order to produce the toner particles by polymerization, attention must be paid to polymerization inhibitory action or dispersion medium transfer properties inherent in the colorant. Particle surfaces of the colorant may optionally be subjected to surface treatment with a material free from polymerization inhibition, to make surface modification. In particular, most dyes and carbon black have the polymerization inhibitory action and hence care must be taken when used.

A preferable method for the treatment of the dyes may include a method in which a polymerizable monomer is previously polymerized in the presence of any of these dyes. The resultant colored polymer may be added to the polymerizable monomer composition. With regard to the carbon black, besides the same treatment as the above on the dyes, it may be treated with a material capable of reacting with surface functional groups of the carbon black, as exemplified by organosiloxane.

The toner of the present invention may be used in either of a non-magnetic toner and a magnetic toner. Where the toner of the present invention is used as a magnetic toner, it may be incorporated therein with a magnetic powder. As the magnetic powder, a material capable of being magnetized when placed in a magnetic field may be used, which include, e.g., powders of ferromagnetic metals such as iron, cobalt and nickel, and powders of magnetic iron oxides such as magnetite and ferrite.

Where magnetic toner particles are produced by polymerization, attention must be paid to polymerization inhibitory action or dispersion medium transfer properties inherent in the magnetic material. If necessary, particle surfaces of the magnetic material may preferably beforehand be subjected to surface modification (e.g., surface treatment with a material free from polymerization inhibition).

In the course of the production of toner particles, the temperature may be raised at the latter half of polymerization reaction, and also the dispersion medium may be removed in part at the latter half of the reaction or after the reaction has been completed, in order to remove unreacted polymerizable monomers or by-products that may cause a smell when the toner is fixed. After the reaction has been completed, the toner particles formed are collected by washing and filtration, followed by drying.

In the suspension polymerization, water may preferably be used as the dispersion medium in an amount of from 300 to 3,000 parts by weight based on 100 parts by weight of the polymerizable monomer composition.

In the fixing of the toner of the present invention, the fixable temperature range refers to the temperature range between low-temperature offset end temperature and high-temperature offset start temperature.

How to measure the physical properties and how to evaluate performance, relating to the toner of the present invention, are described below.

DSC Measurement

In the present invention, M-DSC (manufactured by TA Instruments Ltd.) is used as a differential scanning calorimeter (DSC). A toner sample for measurement is precisely weighed in an amount of 6 mg. This sample is put into an aluminum pan and an empty aluminum pan is used as reference. Measurement is made in a normal-temperature and normal-humidity environment at a heating rate of 1.0° C./min within the measurement temperature range of from 20° C. to 200° C. Here, the measurement is made at a modulation amplitude of plus-minus 0.5° C. and a frequency of I/min. From the reversing heat flow curve obtained, the maximum glass transition point Tg (° C.) is calculated. As to the Tg, the center value between the points at which the base lines before and after endothermism and the tangent line of the curve according to the endothermism intersect is found as Tg (° C.).

Figure 7:
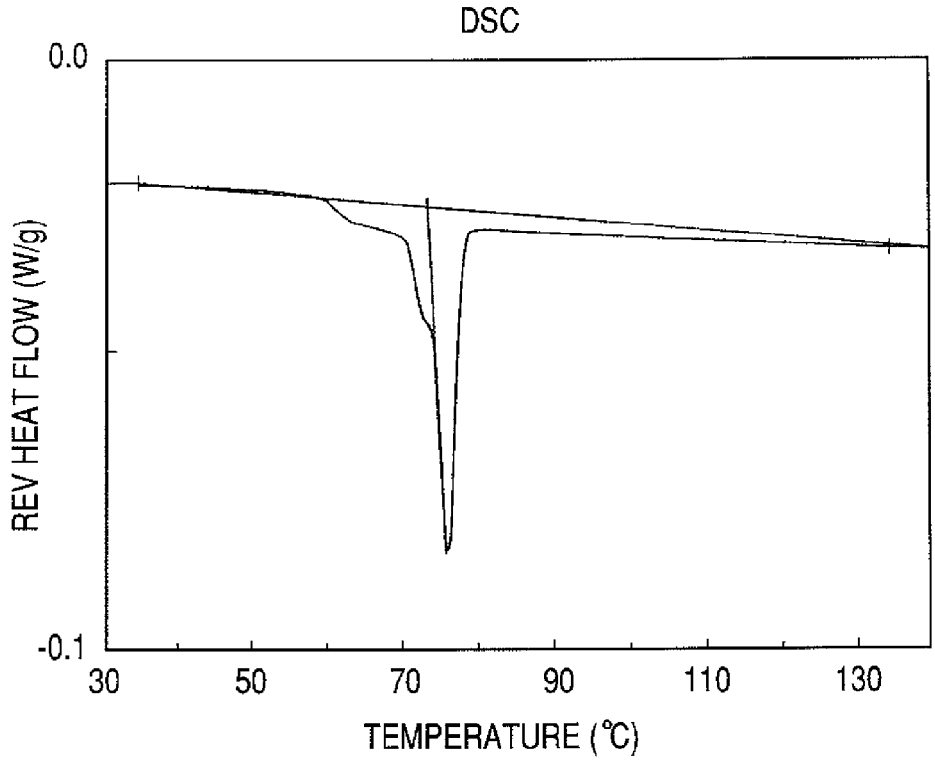
FIG. 7 shows an example of an endothermic chart of a toner as measured by DSC.

In the endothermic chart at the time of heating as measured by DSC, the calorimetric integral value (J/g) per 1 g of the toner, represented by the peak area of the endothermic main peak, is measured. Stated specifically, an analysis software UNIVERSAL ANALYSIS Ver. 2.5H (available from TA Instruments Ltd.) is used. Using a function of Integral Peak Linear in that software, the calorimetric integral value is determined according to the reversing heat flow curve obtained from the above measurement. That is, what is calculated from a region surrounded by a straight line which connects points of measurement at 35° C. and 135° C. and by the reversing heat flow curve is regarded as the calorimetric integral value (J/g) per 1 g of the toner, represented by the peak area of the endothermic main peak. An example of the reversing heat flow curve obtained by the DSC measurement is shown in FIG. 7. In FIG. 7 showing the reversing heat flow curve, the ordinate shows reversing heat flow (W/g); and the abscissa, temperature (° C.).

Measurement of Weight-Average Particle Diameter of Toner

To 100 to 150 ml of an electrolytic solution, 0.1 to 5 ml of a surface active agent (an alkylbenzenesulfonate) is added, and 2 to 20 mg of a sample for measurement is added thereto. The electrolytic solution in which the sample has been suspended is subjected to dispersion for 1 to 3 minutes in an ultrasonic dispersion machine. Using Coulter Counter Multisizer and using an aperture of 100 μm, the particle size distribution of particles of 2 to 40 μm in diameter is measured on the basis of volume, and the weight-average particle diameter of the toner is calculated.

Fixing Test

A fixing unit of a full-color laser printer (LBP-2510, manufactured by CANON, INC.) was so altered that its fixing temperature was controllable, and was used as an altered fixing assembly. Using this printer, unfixed toner images (0.5 mg/cm$^2$) were oilless-fixed to image receiving paper (75 g/m$^2$) by the application of heat and pressure at a process speed of 120 mm/sec and at fixing temperature ranging from 110 to 240° C. at intervals of 5° C., to form fixed images on the image receiving paper.

As to fixing performance, the fixed images were rubbed 10 times with KIMWIPE S-200" (available from Crecia Corporation). The temperature at which the rate of decrease in density before and after rubbing came to less than 5% was regarded as fixing temperature, and was used in the evaluation of fixing performance.

Measurement of Image Density

Fixed-image areas were measured with Macbeth densitometer, using an SPI auxiliary filter.

Measurement of Running Image Density

In the case of non-magnetic toner:

An altered machine (process speed: 120 mm/sec; fixing temperature: 190° C.) of a full-color laser printer (LBP-2510, manufactured by CANON, INC.) was used. In this printer, 200 g of a toner was set in its process cartridge and images were printed in environments of low-temperature and low-humidity (L/L: 16° C./15% RH), normal-temperature and normal-humidity (N/N: 24° C./60% RH) and high-temperature and high-humidity (H/H: 30° C./76% RH). Stated specifically, an image of 2% in print percentage was printed on recording paper (75 mg/cm$^2$) up to 8,000 sheets, and solid-image densities at the initial stage and at printing on 8,000 sheets were measured to make evaluation.

Rank A: 1.45 or more.
Rank B: From 1.44 to 1.40.
Rank C: From 1.39 to 1.35.
Rank D: From 1.34 to 1.30.
Rank E: From 1.29 to 1.25.
Rank F: 1.24 or less.

In the case of magnetic toner:

Measured and evaluated under the same conditions as the case of non-magnetic toner except that, in place of LBP-2510, an altered machine (process speed: 120 mm/sec; fixing temperature: 190° C.) of LBP-2160 (manufactured by CANON, INC.) was used as the full-color laser printer.

Rank A: 1.45 or more.
Rank B: From 1.44 to 1.40.
Rank C: From 1.39 to 1.35.
Rank D: From 1.34 to 1.30.
Rank E: From 1.29 to 1.25.
Rank F: 1.24 or less.

Blocking Test

About 10 g each of toners were put into 100 ml glass bottles. These were left for 10 days at 45° C. and 50° C., and thereafter visually judged.

Rank A: No change.
Rank B: Agglomerates are seen, but readily break up.
Rank C: Agglomerates can not easily break up.
Rank. D: No fluidity is seen.
Rank E: Apparent caking.

Gloss Evaluation

Images present in fixed-image areas were measured with a handy gloss meter GLOSS CHECKER IG-310 (manufactured by Horiba Ltd.) to find gloss values.

EXAMPLES

The present invention is described below by giving Examples. The present invention is by no means limited by these Examples. Incidentally, "part(s)" termed in Examples refers to "part(s) by weight" in all occurrences.

Production of Styrene Resin (1)

Into a reactor having a dropping funnel, a Liebig condenser and a stirrer, 600.0 parts of xylene was introduced, and then heated to 135° C. Next, a mixture of 100.0 parts of styrene monomer, 0.1 part of n-butyl acrylate and 13.0 parts of di-tert-butyl peroxide was charged into the dropping funnel, and was dropwise added to the 135° C. xylene over a period of 2 hours. Further under reflux of xylene (137° C. to 145° C.), solution polymerization was completed, and then the xylene was removed to obtain a styrene resin (1). The styrene resin (1) obtained had a weight-average molecular weight (Mw) of 3,200, an Mw/Mn of 1.19 and a glass transition point (Tg) of 55° C.

Production of Styrene Resins (2) to (4), (6), (9) and (10)

Styrene resins (2) to (4), (6), (9) and (10), respectively, were produced by the same production process as that for the styrene resin (1) except that the styrene monomer, the n-butyl acrylate, the di-tert-butyl peroxide and the xylene were used with their addition in the amounts shown in Table 2. The styrene resins (2) to (4), (6), (9) and (10) obtained each had weight-average molecular weight (Mw), Mw/Mn and glass transition point (Tg) as shown in Table 2. Incidentally, "–" noted in Table 2 means that the material is not added.

Production of Styrene Resin (5)

A mixture of 50.0 parts of xylene, 80.0 parts of styrene monomer, 20.0 parts of n-butyl acrylate and 2.0 parts of di-tert-butyl peroxide was charged into a reactor having a Liebig condenser and a stirrer. Then, polymerization was carried out at a polymerization temperature of 125° C. for 24 hours. Thereafter, the xylene was removed to obtain a styrene resin (5). The styrene resin (5) obtained had a weight-average molecular weight (Mw) of 290,000, an Mw/Mn of 12.40 and a glass transition point (Tg) of 64° C.

Production of Styrene Resins (7) and (8)

Styrene resins (7) and (8), respectively, were produced by the same production process as that for the styrene resin (5) except that the styrene monomer, the n-butyl acrylate, the di-tert-butyl peroxide, a cross-linking agent (DVB) and the xylene were used with their addition in the amounts shown in Table 2. The styrene resins (7) and (8) obtained each had weight-average molecular weight (Mw), Mw/Mn and glass transition point (Tg) as shown in Table 2. Incidentally, DVB stands for divinylbenzene.

Example 1

Into a four-necked flask, 710 parts of ion-exchanged water and 850 parts of an aqueous 0.1 mol/liter $Na_3PO_4$ solution were introduced, and the mixture was kept at 60° C. with stirring by means of a high-speed stirrer TK-type homomixer at 12,000 rpm. Then, 68 parts of an aqueous 0.1 mol/liter $CaCl_2$ solution was slowly added thereto to prepare an aqueous dispersion medium containing a fine-particle slightly water-soluble dispersion stabilizer $Ca_3(PO_4)_2$.

| | |
|---|---|
| Styrene monomer | 124.0 parts |
| n-Butyl acrylate | 36.0 parts |
| Copper phthalocyanine pigment | 13.0 parts |
| Styrene resin (1) (Mw: 3,200; Mw/Mn: 1.19) | 40.0 parts |
| Polyester resin (1) [terephthalic acid-propylene oxide modified bisphenol A (2 mol addition product)-ethylene oxide modified bisphenol A (2 mol addition product) (molar ratio: 51:30:20); acid value: 9; glass transition point: 60° C.; Mw: 10,000; Mw/Mn: 3.20) | 10.0 parts |
| Negative charge control agent (aluminum compound of 3,5-di-t-butylsalicylic acid) | 0.8 part |
| Wax [Fischer-Tropsch wax (1); melting point: 78.0° C.] | 15.0 parts |

A monomer mixture 1 composed of the above materials was dispersed for 3 hours by means of an attritor. To this monomer mixture 1, 20.0 parts of a polymerization initiator 1,1,3,3-tetramethylbutyl peroxy-2-ethylhexanoate (a 50% toluene solution) was added to obtain a polymerizable monomer composition, and this was put into the above aqueous dispersion medium. Then, granulation was carried out for 5 minutes while maintaining the number of revolution of the stirrer at 10,000 rpm. Thereafter, the high-speed stirrer was changed for a propeller stirrer, and the internal temperature was raised to 70° C., where the reaction was carried out for 6 hours with slow stirring. The raw materials are shown in Table 1, and the physical properties of the styrene resin (1) in Table 2.

Next, the interior of the container was heated to a temperature of 80° C., which was maintained for 4 hours, and was thereafter slowly cooled to 30° C. at a cooling rate of 1° C. per minute to obtain a slurry 1. To the interior of the container containing the slurry 1, dilute hydrochloric acid was added to remove the dispersion stabilizer, further followed by filtration, washing and drying to obtain polymer particles (toner particles 1) having a weight-average particle diameter of 6.2 μm.

To the toner particles 1 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (1-1). Besides, toner physical properties of the toner (1-1) were measured to obtain the results shown in Table 1.

Measurement results of the molecular weight distribution measured by GPC of THF-soluble matter of the toner (1-1) are shown in Table 3.

200 g of the toner (1-1) was set in the process cartridge of the altered machine of the laser beam printer (LBP-2510, manufactured by CANON, INC.) and images were printed in environments of low-temperature and low-humidity (L/L: 16° C./15% RH), normal-temperature and normal-humidity (N/N: 24° C./60% RH) and high-temperature and high-humidity (H/H: 30° C./76% RH). Stated specifically, an image of 2% in print percentage was printed on recording paper up to 8,000 sheets, and solid-image densities at the initial stage and at printing on 8,000 sheets were measured to make evaluation. The results are shown in Table 4. Next, fixing performance was evaluated to obtain the results also shown in Table 4.

Example 2

Toner particles 2 were obtained in the same manner as in Example 1 except that the raw materials were used as shown in Table 1.

To the toner particles 2 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (2-1). Physical properties of the toner (2-1) are shown in Table 1.

Measurement concerning the molecular weight distribution of the toner (2-1) obtained was made in the same manner as in Example 1. The results of measurement are shown in Table 3.

As in Example 1, the toner (2-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 3

Toner particles 3 were obtained in the same manner as in Example 1 except that the raw materials were used as shown in Table 1.

To the toner particles 3 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (3-1). Physical properties of the toner (3-1) are shown in Table 1.

Measurement concerning the molecular weight distribution of the toner (3-1) obtained was made in the same manner as in Example 1. The results of measurement are shown in Table 3.

As in Example 1, the toner (3-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 4

Toner particles 4 were obtained in the same manner as in Example 1 except that the raw materials were used as shown in Table 1.

To the toner particles 4 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (4-1). Physical properties of the toner (4-1) are shown in Table 1.

Measurement concerning the molecular weight distribution of the toner (4-1) obtained was made in the same manner as in Example 1. The results of measurement are shown in Table 3.

As in Example 1, the toner (4-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 5

Toner particles 5 were obtained in the same manner as in Example 1 except that the raw materials were used as shown in Table 1.

To the toner particles 5 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (5-1). Physical properties of the toner (5-1) are shown in Table 1.

Measurement concerning the molecular weight distribution of the toner (5-1) obtained was made in the same manner as in Example 1. The results of measurement are shown in Table 3.

As in Example 1, the toner (5-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 6

Toner particles 6 were obtained in the same manner as in Example 1 except that the raw materials were used as shown in Table 1.

To the toner particles 6 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (6-1). Physical properties of the toner (6-1) are shown in Table 1.

Measurement concerning the molecular weight distribution of the toner (6-1) obtained was made in the same manner as in Example 1. The results of measurement are shown in Table 3.

As in Example 1, the toner (6-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 7

Toner particles 7 were obtained in the same manner as in Example 1 except that the raw materials were used as shown in Table 1.

To the toner particles 7 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (7-1). Physical properties of the toner (7-1) are shown in Table 1.

Measurement concerning the molecular weight distribution of the toner (7-1) obtained was made in the same manner as in Example 1. The results of measurement are shown in Table 3.

As in Example 1, the toner (7-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 8

To the slurry 1 obtained in Example 1, a ferrite carrier (500.0 parts) of 40 μm in particle diameter, having been coated with a styrene-methyl methacrylate copolymer was added, and these were stirred at 60° C. for 1 hour with uniform stirring by means of a stirring blade. This was cooled to 30° C., and thereafter dilute hydrochloric acid was added to remove the dispersion stabilizer, further followed by filtration, washing and drying to obtain toner particles 8.

To the toner particles 8 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (8-1). Physical properties of the toner (8-1) are shown in Table 1.

Measurement concerning the molecular weight distribution of the toner (8-1) obtained was made in the same manner as in Example 1. The results of measurement are shown in Table 3.

As in Example 1, the toner (8-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 1

| | |
|---|---|
| Styrene resin (4) | 40.0 parts |
| Styrene resin (5) (styrene-n-butyl acrylate copolymer; copolymerization ratio: 80:20 in weight ratio; Mw: 290,000; Mw/Mn: 12.40) | 160.0 parts |
| Polyester resin (1) [terephthalic acid-propylene oxide modified bisphenol A (2 mol addition product)-ethylene oxide modified bisphenol A (2 mol addition product) (molar ratio: 51:30:20); acid value: 9; glass transition point: 60° C.; Mw: 10,000; Mw/Mn: 3.20) | 10.0 parts |
| Copper phthalocyanine pigment | 13.0 parts |
| Negative charge control agent (aluminum compound of 3,5-di-t-butylsalicylic acid) | 0.8 part |
| Wax [Fischer-Tropsch wax (1); melting point: 78.0° C.] | 15.0 parts |

The above materials were mixed by means of Henschel mixer. Thereafter, the mixture obtained was melt-kneaded by means of a twin-screw extruder at 130° C. The kneaded product obtained was cooled, and the kneaded product cooled was crushed using a cutter mill, followed by pulverization by means of a fine grinding mill making used of jet streams, and further followed by classification by means of an air classifier to obtain toner particles 9 having a weight-average particle diameter of 6.7 μm.

To the toner particles 9 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (9-1). Physical properties of the toner (9-1) are shown in Table 1.

Measurement concerning the molecular weight distribution of the toner (9-1) obtained was made in the same manner as in Example 1. The results of measurement are shown in Table 3.

As in Example 1, the toner (9-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 2

Toner particles 10 were obtained in the same manner as in Comparative Example 1 except that the raw materials were used as shown in Table 1.

To the toner particles 10 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (10-1). Physical properties of the toner (10-1) are shown in Table 1.

Measurement concerning the molecular weight distribution of the toner (10-1) obtained was made in the same manner as in Example 1. The results of measurement are shown in Table 3.

As in Example 1, the toner (10-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 3

Toner particles 11 were obtained in the same manner as in Comparative Example 1 except that the raw materials were used as shown in Table 1.

To the toner particles 11 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (11-1). Physical properties of the toner (11-1) are shown in Table 1.

Measurement concerning the molecular weight distribution of the toner (11-1) obtained was made in the same manner as in Example 1. The results of measurement are shown in Table 3.

As in Example 1, the toner (11-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 4

Toner particles 12 were obtained in the same manner as in Example 1 except that the raw materials were used as shown in Table 1.

To the toner particles 12 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (12-1). Physical properties of the toner (12-1) are shown in Table 1.

Figure 8:
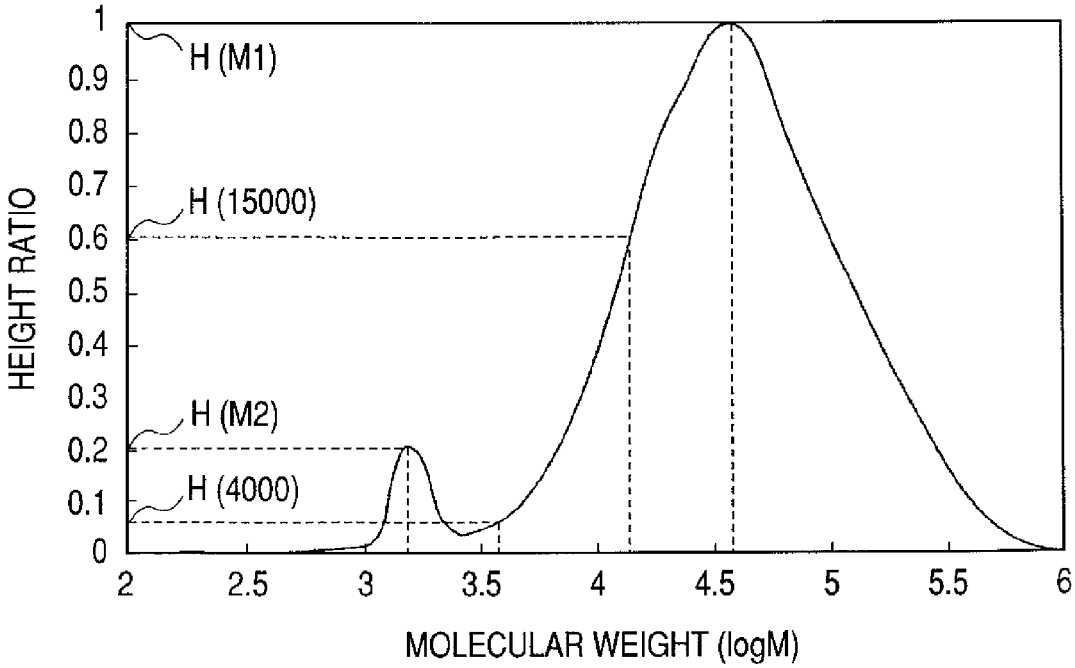
FIG. 8 shows an example of a chart of molecular weight distribution measured by GPC of THF-soluble matter of a toner (12-1) used in Comparative Example 4.

Measurement concerning the molecular weight distribution of the toner (12-1) obtained was made in the same manner as in Example 1. The results of measurement are shown in Table 3. A chart of molecular weight distribution measured by GPC of THF-soluble matter of the toner (12-1) as obtained at that time is shown in FIG. 8.

As in Example 1, the toner (12-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 5

Toner particles 13 were obtained in the same manner as in Example 1 except that the raw materials were used as shown in Table 1.

To the toner particles 13 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (13-1). Physical properties of the toner (13-1) are shown in Table 1.

Measurement concerning the molecular weight distribution of the toner (13-1) obtained was made in the same manner as in Example 1. The results of measurement are shown in Table 3.

As in Example 1, the toner (13-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 6

Toner particles 14 were obtained in the same manner as in Example 1 except that the raw materials were used as shown in Table 1.

To the toner particles 14 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (14-1). Physical properties of the toner (14-1) are shown in Table 1.

Measurement concerning the molecular weight distribution of the toner (14-1) obtained was made in the same manner as in Example 1. The results of measurement are shown in Table 3.

As in Example 1, the toner (14-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 7

Toner particles 15 were obtained in the same manner as in Example 1 except that the raw materials were used as shown in Table 1.

To the toner particles 15 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (15-1). Physical properties of the toner (15-1) are shown in Table 1.

Measurement concerning the molecular weight distribution of the toner (15-1) obtained was made in the same manner as in Example 1. The results of measurement are shown in Table 3.

As in Example 1, the toner (15-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 8

Preparation of Dispersion of Fine Colorant Particles 0.90 part of sodium n-dodecylsulfate (ADEKA HOPE LS-900, available from Asahi Denka Kogyo K.K.) and 10.0 parts of ion-exchanged water were charged into a resin container, and this system was stirred to prepare an aqueous solution of the sodium n-dodecylsulfate. While this aqueous solution was stirred, 1.2 parts of carbon black "REGAL 330R" (available from Cabot Corp.) was slowly added. After its addition, the mixture was stirred for 1 hour, and then the carbon black was continuously dispersion-treated over a period of 20 hours by means of a medium type dispersion machine to prepare a dispersion of fine colorant particles (hereinafter "colorant dispersion (C)") The particle diameter of the fine colorant particles in this colorant dispersion (C) was measured with an electrophoretic light scattering photometer "ELS-800" (manufactured by Otsuka Electronics Co., Ltd.) to find that it was 122 nm in weight-average particle diameter. Also, the solid concentration of the colorant dispersion (C) as measured by the drying-at-rest gravimetric method was 16.6% by weight.

(Preparation of Dispersion of Fine Release Agent Particles)

Using polypropylene (PP) produced by a conventional synthesis method, it was thermally decomposed in the state it was melted by heating, to obtain fine release agent particles, polypropylene 1.

1.05 kg of the fine release agent particles (polypropylene 1) obtained were added to 2.45 kg of an aqueous solution of a surface-active agent (nonylphenoxyethyl alcohol), and the pH of the mixture obtained was adjusted to 9 with potassium hydroxide. This system was heated under pressure, to a temperature of not lower than the softening point of the release agent to carry out emulsification dispersion treatment of the release agent to prepare a dispersion of the fine release agent particles, having a solid content of 30% by weight. This dispersion was designated as "release agent dispersion W1".

Preparation of Aqueous Solution of Surface-active Agent

Preparation Example S-1

0.055 part of an anionic surface-active agent sodium dodecylbenzenesulfonate (available from Kanto Chemical Co., Inc.) and 4.0 parts of ion-exchanged water were charged into a stainless-steel pot. Then, this system was stirred at room temperature to prepare an aqueous solution of the anionic surface-active agent (hereinafter "surfactant solution (S-1)").

Preparation Example S-2

0.014 part of a nonionic surface-active agent "NEW COAL 565C" (available from Nippon Nyukazai Co., Ltd. and 4.0 parts of ion-exchanged water were charged into a stainless-steel pot. Then, this system was stirred at room temperature to prepare an aqueous solution of the nonionic surface-active agent (hereinafter "surfactant solution (S-2)").

Preparation Example S-3

1.00 part of a nonionic surface-active agent "FC-170C" (available from Sumitomo 3M Limited) and 1,000 parts of ion-exchanged water were charged into a glass beaker. Then, this system was stirred at room temperature to prepare an aqueous solution of the nonionic surface-active agent (hereinafter "surfactant solution (S-3)").

Preparation of Aqueous Solution of Polymerization Initiator

Preparation Example P-1

200.7 parts of a polymerization initiator potassium persulfate (available from Kanto Chemical Co., Inc.) and 12,000 parts of ion-exchanged water were charged into an enamel pot. Then, this system was stirred at room temperature to prepare an aqueous solution of the polymerization initiator (hereinafter "initiator solution (P-1)").

Preparation Example P-2

223.8 parts of a polymerization initiator potassium persulfate (available from Kanto Chemical Co., Inc.) and 12,000 parts of ion-exchanged water were charged into an enamel pot. Then, this system was stirred at room temperature to prepare an aqueous solution of the polymerization initiator (hereinafter "initiator solution (P-2)").

(Preparation of Aqueous Solution of Sodium Chloride)

5.36 parts of a salting-out agent sodium chloride (available from Wako Pure Chemical Industries, Ltd.) and 20.0 parts of ion-exchanged water were charged into a stainless-steel pot. Then, this system was stirred at room temperature to prepare an aqueous solution of the sodium chloride (hereinafter "sodium chloride solution (N)").

Production of Toner Particles

Production Example 1

(i) Preparation of dispersion of fine resin particles (A): A reaction vessel of 100 liters in internal volume was readied which had a temperature sensor, a cooling tube, a nitrogen feeder and a stirring blade and the inner wall of which was treated to have a glass lining. Into this reaction vessel, 4.0 liters of the surfactant solution (S-1) and 4.0 liters of the surfactant solution (S-2) were charged, and 44.0 liters of ion-exchanged water was added thereto with stirring at room temperature. This system was heated. At the time the system came to have a temperature of 75° C., 12.0 liters of the initiator solution (P-2) was added. Then, controlling the temperature of the system at 75° C. plus-minus 1° C., a monomer mixture composed of 12.0 kg of styrene, 2.9 kg of n-butyl acrylate, 1.0 kg of methacrylic acid and 550 g of t-dodecyl mercaptan was added over a period of 180 minutes by means of a feed pump having a quantity meter. Then, controlling the temperature of this system at 80° C. plus-minus 1° C., stirring was carried out over a period of 5 hours. Thereafter, the system was cooled until its temperature came to be 40° C. or less, where the stirring was stopped, and scales (foreign matter) were removed by filtration with a polefilter to prepare a dispersion of fine resin particles (A) composed of a low-molecular weight resin (hereinafter "low-molecular weight latex (A)"). The fine resin particles constituting this low-molecular weight latex (A)" had a weight-average particle diameter of 105 nm.

(ii) Preparation of dispersion of fine resin particles (B): A reaction vessel of 100 liters in internal volume was readied which had a temperature sensor, a cooling tube, a nitrogen feeder and a stirring blade and the inner wall of which was treated to have a glass lining. Into this reaction vessel, 4.0 liters of the surfactant solution (S-1) and 4.0 liters of the surfactant solution (S-2) were charged, and, stirring this system at room temperature, 44.0 liters of ion-exchanged water was added thereto. This system was heated. At the time the system came to have a temperature of 70° C., 12.0 liters of the initiator solution (P-1) was added. Then, controlling the temperature of the system at 70° C. plus-minus 1° C., a monomer mixture composed of 11.0 kg of styrene, 4.00 kg of n-butyl acrylate, 1.0 kg of methacrylic acid and 9.0 g of t-dodecyl mercaptan was added over a period of 180 minutes by means of a feed pump having a quantity meter. Then, controlling the temperature of this system at 72° C. plus-minus 2° C., stirring was carried out over a period of 5 hours. Further, controlling the temperature of this system at 80° C. plus-minus 2° C., stirring was carried out over a period of 12 hours. Thereafter, the system was cooled until its temperature came to be 40° C. or less, where the stirring was stopped, and scales (foreign matter) were removed by filtration with a polefilter to prepare a dispersion of fine resin particles (B) composed of a high-molecular weight resin (hereinafter "high-molecular weight latex (B)"). The fine resin particles constituting this high-molecular weight latex (B)" had a weight-average particle diameter of 102 nm.

(iii) Production of toner particles (salting-out/fusion step): A reaction vessel made of stainless steel of 100 liters in internal volume was readied which had a temperature sensor, a cooling tube, a nitrogen feeder, a comb-shaped baffle and a stirring blade (an anchor blade). Into this reaction vessel, 20.0 kg of the low-molecular weight latex (A), 5.0 kg of the high-molecular weight latex (B), 0.4 kg of the colorant dispersion (C), 1.02 kg of the release agent dispersion (W1) and 20.0 kg of ion-exchanged water were charged, and this system was stirred at room temperature. The system was heated to a temperature of 40° C., and 20 liters of the sodium chloride solution (N), 6.00 kg of isopropyl alcohol (available from Kanto Chemical Co., Inc.) and 1.0 liter of the surfactant solution (S-3) were added thereto in this order. This system was left for 10 minutes and thereafter started being heated, and was heated to 85° C. over a period of 60 minutes, followed by stirring at 85° C. plus-minus 2° C. for 6 hours. Thus, the fine resin particles composed of a high-molecular weight resin, the fine resin particles composed of a low-molecular weight resin, the fine colorant particles and the fine release agent particles (PP1 for the present invention) were made to undergo salting-out/fusion to form toner particles. The system was cooled until its temperature came to be 40° C. or less, where the stirring was stopped, and agglomerates were removed by filtration with a filter of 45 μm in mesh to obtain a dispersion of the toner particles. Next, from the dispersion obtained, a wet cake (a mass of toner particles) was separated by filtration under reduced pressure, using a Nutsche filter, and this was treated by washing with ion-exchanged water. The wet cake having been treated by washing was taken out of the Nutsche filter. Crushing this cake into small pieces, the crushed one was spread on five sheets of uncut-paper pads, and these were covered with kraft paper, followed by drying over a period of 100 hours by means of a 40° C. air dryer to obtain a mass of block-form toner particles. Next, this mass was disintegrated by means of Henschel grinding mill to obtain toner particles 16.

To the toner particles 16 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (16-1). Physical properties of the toner (16-1) are shown in Table 5.

Measurement concerning the molecular weight distribution of the toner (16-1) obtained was made in the same manner as in Example 1. The results of measurement are shown in Table 3.

As in Example 1, the toner (16-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Comparative Example 9

Using polyethylene (PE), it was thermally decomposed in the state it was melted by heating, to obtain fine release agent particles, polyethylene 1.

1.05 kg of the fine release agent particles (polyethylene 1) obtained were added to 2.45 kg of an aqueous solution of a surface-active agent (nonylphenoxyethyl alcohol), and the pH of the mixture obtained was adjusted to 9 with potassium hydroxide. This system was heated under pressure, to a temperature of not lower than the softening point of the release agent to carry out emulsification dispersion treatment of the release agent to prepare a dispersion of the fine release agent particles, having a solid content of 30% by weight. This dispersion was designated as "release agent dispersion W2".

Toner particles 17 were obtained in the same manner as in Comparative Example 8 except that, in the salting-out/fusion step in Comparative Example 8, 1.02 kg of the release agent dispersion (W2) was used in place of the release agent dispersion (W1).

To the toner particles 17 (100.0 parts) obtained, 0.8 part of hydrophobic silica having a specific surface area of 200 $m^2/g$ as measured by the BET method and 0.1 part of titanium oxide having a specific surface area of 100 $m^2/g$ as measured by the BET method were externally added to obtain a toner (17-1). Physical properties of the toner (17-1) are shown in Table 5.

Measurement concerning the molecular weight distribution of the toner (17-1) obtained was made in the same manner as in Example 1. The results of measurement are shown in Table 3.

As in Example 1, the toner (17-1) was set in the process cartridge of the altered machine of the laser beam printer (LBP-2510, manufactured by CANON, INC.) to make the same image evaluation as that in Example 1. Next, the same fixing performance evaluation as that in Example 1 was made. The results of these are shown in Table 4.

Example 9

Production of Hydrophobic Magnetic Iron Oxide 1

In an aqueous ferrous sulfate solution, a sodium hydroxide solution was mixed in an equivalent weight of from 1.0 to 1.05 based on iron ions, to prepare an aqueous solution containing ferrous hydroxide. Maintaining the pH of the aqueous solution at 8, air was blown into it to effect oxidation reaction at 85 to 90° C. to prepare a slurry fluid from which seed crystals were to be formed. Nex, to this slurry fluid, an aqueous ferrous sulfate solution was so added as to be in an equivalent weight of from 0.9 to 1.15 based on the initial alkali content (the sodium component in the sodium hydroxide). Thereafter, the pH of the slurry fluid was maintained at 8. Then, oxidation reaction was carried on while air was blown into it. At the end of the oxidation reaction, the pH was adjusted to about 6, and the oxidation reaction was completed. The iron oxide particles thus formed were washed, filtered and then taken out, which were then, without being dried, re-dispersed in another water. The pH of the re-dispersion formed was adjusted, and then a coupling agent n-hexyltrimethoxysilane was added thereto with thorough stirring, in an amount of 2.5 parts based on 100 parts by weight of magnetic iron oxide to carry out stirring sufficiently. The hydrophobic iron oxide particles thus formed were washed, filtered and then dried, followed by disintegration of particles standing a little agglomerate, to obtain a hydrophobic magnetic iron oxide 1 having an average particle diameter of 0.17 μm.

Into a four-necked flask, 710 parts of ion-exchanged water and 460 parts of an aqueous 0.1 mol/liter $Na_3PO_4$ solution were introduced, and the mixture was kept at 60° C. with stirring by means of a high-speed stirrer TK-type homomixer at 11,000 rpm. Then, 68 parts of an aqueous 0.1 mol/liter $CaCl_2$ solution was slowly added thereto to prepare an aqueous dispersion medium containing a fine-particle slightly water-soluble dispersion stabilizer $Ca_3(PO_4)_2$.

| | |
|---|---|
| Styrene monomer | 124.0 parts |
| n-Butyl acrylate | 36.0 parts |
| Hydrophobic magnetic iron oxide 1 | 190.0 parts |
| Styrene resin (1) (Mw: 3,200; Mw/Mn: 1.19) | 40.0 parts |

-continued

| | |
|---|---|
| Polyester resin (1) [terephthalic acid-propylene oxide modified bisphenol A (2 mol addition product)-ethylene oxide modified bisphenol A (2 mol addition product) (molar ratio: 51:30:20); acid value: 9; glass transition point: 60° C.; Mw: 10,000; Mw/Mn: 3.20] | 10.0 parts |
| Negative charge control agent (aluminum compound of 3,5-di-t-butylsalicylic acid) | 0.8 part |
| Wax [Fischer-Tropsch wax (1); melting point: 78.0° C.] | 15.0 parts |

A monomer mixture 2 composed of the above materials was dispersed for 3 hours by means of an attritor. To this monomer mixture 2, 8 parts of a polymerization initiator 1,1,3,3-tetramethylbutyl peroxy-2-ethylhexanoate (a 50% toluene solution) was added to obtain a polymerizable monomer composition, and this was put into the above aqueous dispersion medium. Then, granulation was carried out for 5 minutes while maintaining the number of revolution of the stirrer at 10,000 rpm. Thereafter, the high-speed stirrer was changed for a propeller stirrer, and the internal temperature was raised to 80° C., where the reaction was carried out for 8 hours with slow stirring. The raw materials are shown in Table 1, and the physical properties of the styrene resin (1) in Table 2.

Next, the interior of the container was slowly cooled to 30° C. at a cooling rate of 1° C. per minute to obtain a slurry 2. To the interior of the container containing the slurry 2, dilute hydrochloric acid was added to remove the dispersion stabilizer, further followed by filtration, washing and drying to obtain polymer particles (toner particles 18) having a weight-average particle diameter of 6.1 μm.

To the toner particles 18 (100.0 parts) obtained, 1.0 part of hydrophobic silica having a specific surface area of 120 $m^2/g$ as measured by the BET method was externally added to obtain a toner (18-1). Besides, toner physical properties of the toner (18-1) were measured to obtain the results shown in Table 1.

Measurement results of the molecular weight distribution measured by GPC of THF-soluble matter of the toner (18-1) are shown in Table 3.

An LBP-2160 altered machine of a printer LBP-2160 (manufactured by CANON, INC.), from which its fixing assembly was detached and the process speed was set to 120 mm/sec, was used as an image forming apparatus, and a 8,000-sheet image reproduction test was conducted in a normal-temperature and normal-humidity environment. Unfixed images were reproduced using the LBP-2160 altered machine, and were fixed using an altered fixing assembly of LBP-2510 obtained by, as in Example 1, altering the fixing unit of LBP-2510 (manufactured by CANON, INC.) so that its fixing temperature was controllable.

500 g of the toner (18-1) was set in the process cartridge and images were printed in environments of low-temperature and low-humidity (L/L: 16° C./15% RH), normal-temperature and normal-humidity (N/N: 24° C./60% RH) and high-temperature and high-humidity (H/H: 30° C./76% RH). Stated specifically, an image of 2% in print percentage was printed on up to 8,000 sheets, and solid-image densities at the initial stage and at printing on 8,000 sheets were measured to make evaluation. The results are shown in Table 4. Next, fixing performance was evaluated to obtain the results also shown in Table 4.

Example 10

Into a four-necked flask, 710 parts of ion-exchanged water and 850 parts of an aqueous 0.1 mol/liter $Na_3PO_4$ solution were introduced, and the mixture was kept at 60° C. with stirring by means of a high-speed stirrer TK-type homomixer at 12,000 rpm. Then, 68 parts of an aqueous 0.1 mol/liter $CaCl_2$ solution was slowly added thereto to prepare an aqueous dispersion medium containing a fine-particle slightly water-soluble dispersion stabilizer $Ca_3(PO_4)_2$.

| | |
|---|---|
| Styrene monomer | 160.0 parts |
| n-Butyl acrylate | 40.0 parts |
| Copper phthalocyanine pigment | 13.0 parts |
| Polyester resin (1) [terephthalic acid-propylene oxide modified bisphenol A (2 mol addition product)-ethylene oxide modified bisphenol A (2 mol addition product) (molar ratio: 51:30:20); acid value: 9; glass transition point: 60° C.; Mw: 10,000; Mw/Mn: 3.20] | 10.0 parts |
| Negative charge control agent (aluminum compound of 3,5-di-t-butylsalicylic acid) | 0.8 part |
| Wax [Fischer-Tropsch wax (1); melting point: 78.0° C.] | 15.0 parts |

A monomer mixture 3 composed of the above materials was dispersed for 3 hours by means of an attritor. To this monomer mixture 3, 15.0 parts of a polymerization initiators t-butyl peroxyneodecanoate and 10.0 parts of 1,1,3,3-tetramethylbutyl peroxy-2-ethylhexanoate (a 50% toluene solution) were added. Then, the polymerizable monomer composition thus obtained was put into the above aqueous dispersion medium. Then, granulation was carried out for 5 minutes while maintaining the number of revolution of the stirrer at 10,000 rpm. Thereafter, the high-speed stirrer was changed for a propeller stirrer, and the reaction was carried out for 3 hours at an internal temperature of 60° C. with slow stirring. Further, the internal temperature was raised to 70° C., where the reaction was carried out for 2 hours with slow stirring. The raw materials are shown in Table 1.

Next, the interior of the container was heated to a temperature of 80° C., which was maintained for 4 hours, and was thereafter slowly cooled to 30° C. at a cooling rate of 1° C. per minute to obtain a slurry 3. To the interior of the container containing the slurry 3, dilute hydrochloric acid was added to remove the dispersion stabilizer, further followed by filtration, washing and drying to obtain polymer particles (toner particles 19) having a weight-average particle diameter of 6.4 μm.

To the toner particles 19 (100.0 parts) obtained, 2.0 parts of hydrophobic silica having a specific surface area of 200 $m^2/g$ as measured by the BET method and 0.1 part of titanium oxide having a specific surface area of 100 $m^2/g$ as measured by the BET method were externally added to obtain a toner (19-1). Besides, toner physical properties of the toner (19-1) were measured to obtain the results shown in Table 1.

Measurement results of the molecular weight distribution measured by GPC of THF-soluble matter of the toner (19-1) are shown in Table 3.

200 g of the toner (19-1) was set in the process cartridge and images were printed in environments of low-temperature and low-humidity (L/L: 16° C./15% RH), normal-temperature and normal-humidity (N/N: 24° C./60% RH) and high-temperature and high-humidity (H/H: 30° C./76% RH). Stated specifically, an image of 2% in print percentage was printed on up to 8,000 sheets, and solid-image densities at the initial stage and at printing on 8,000 sheets were measured to make evaluation. The results are shown in Table 4. Next, fixing performance was evaluated to obtain the results also shown in Table 4.

TABLE 1

| | Example | | | |
|---|---|---|---|---|
| | 1 | 2 | 3 | 4 |
| Toner particles: | 1 | 2 | 3 | 4 |
| Monomers<br>Styrene monomer | | | | |
| Amount (pbw):<br>n-Butyl acrylate | 124.0 | 139.5 | 77.5 | 132.0 |
| Amount (pbw):<br>Cross-linking agent<br>DVB | 36.0 | 40.5 | 22.5 | 28.0 |
| Amount (pbw):<br>Initiator(s)<br>1,1,3,3-Tetramethylbutyl peroxy-2-ethylhexanoate | — | — | — | — |
| Amount (pbw):<br>t-Butyl peroxyneodecanoate | 20.0 | 20.0 | 20.0 | 20.0 |
| Amount (pbw):<br>Colorant<br>Copper phthalocyanine | — | — | — | — |
| Amount (pbw):<br>Magnetic iron oxide | 13.0 | 13.0 | 13.0 | 13.0 |
| Amount (pbw):<br>Resins<br>Styrene resin | — | — | — | — |
| Type: | (1) | (2) | (1) | (1) |
| Amount (pbw): | 40.0 | 20.0 | 100.0 | 40.0 |
| Weight-average molecular weight: | 3,200 | 3,300 | 3,200 | 3,200 |
| Glass transition point (° C.): | 55 | 45 | 55 | 55 |
| Type: | St/BA | St/BA | St/BA | St/BA |

TABLE 1-continued

| | | | | |
|---|---|---|---|---|
| Polyester resin | | | | |
| Type: | (1) | (1) | (1) | (1) |
| Amount (pbw): | 10.0 | 10.0 | 10.0 | 10.0 |
| Weight-average molecular weight: | 10,000 | 10,000 | 10,000 | 10,000 |
| Negative charge control agent | | | | |
| Amount (pbw): | 0.8 | 0.8 | 0.8 | 0.8 |
| Wax | | | | |
| Type: | Fischer = Tropsch | Fischer = Tropsch | Fischer = Tropsch | Sasor wax |
| Amount (pbw): | 15.0 | 15.0 | 15.0 | 15.0 |
| Melting point (° C.): | 78.0 | 78.0 | 78.0 | 99.0/111.0 |
| Endotherm (J/g): | 209.4 | 209.4 | 209.4 | 234.9 |
| Polymerization conditions | | | | |
| Temperature (° C.): | 70 | 70 | 70 | 70 |
| Retention time (h): | 6 | 6 | 6 | 6 |
| Temperature (° C.): | 80 | 80 | 80 | 80 |
| Retention time (h): | 4 | 4 | 4 | 4 |
| Toner: | (1-1) | (2-1) | (3-1) | (4-1) |
| Toner physical properties | | | | |
| Weight-average molecular weight: | 38,000 | 52,000 | 29,000 | 46,000 |
| Weight-average particle diameter (μm): | 6.2 | 6.4 | 6.5 | 6.3 |
| Average circularity: | 0.984 | 0.982 | 0.986 | 0.981 |
| Mode circularity: | 1.00 | 1.00 | 1.00 | 1.00 |
| Endothermic main peak temperature (° C.): | 70.4 | 70.3 | 70.2 | 111.0 |
| Endothermic main peak calorimetric integral value (J/g): | 19.7 | 19.5 | 19.4 | 20.6 |
| Glass transition point (° C.): | 58 | 58 | 56 | 57 |

| | Example | | | |
|---|---|---|---|---|
| | 5 | 6 | 7 | 8 |
| Toner particles: | 5 | 6 | 7 | 8 |
| Monomers | | | | |
| Styrene monomer | | | | |
| Amount (pbw): | 77.5 | 124.0 | 147.3 | 124.0 |
| n-Butyl acrylate | | | | |
| Amount (pbw): | 22.5 | 36.0 | 42.8 | 36.0 |
| Cross-linking agent | | | | |
| DVB | | | | |
| Amount (pbw): | — | — | — | — |
| Initiator(s) | | | | |
| 1,1,3,3-Tetramethylbutyl peroxy-2-ethylhexanoate | | | | |
| Amount (pbw): | 40.0 | 20.0 | 20.0 | 20.0 |
| t-Butyl peroxyneodecanoate | | | | |
| Amount (pbw): | — | — | — | — |
| Colorant | | | | |
| Copper phthalocyanine | | | | |
| Amount (pbw): | 13.0 | 13.0 | 13.0 | 13.0 |
| Magnetic iron oxide | | | | |
| Amount (pbw): | — | — | — | — |
| Resins | | | | |
| Styrene resin | | | | |
| Type: | (1) | (1) | (2) | (1) |
| Amount (pbw): | 100.0 | 40.0 | 10.0 | 40.0 |
| Weight-average molecular weight: | 3,200 | 3,200 | 3,300 | 3,200 |
| Glass transition point (° C.): | 55 | 55 | 45 | 55 |
| Type: | St/BA | St/BA | St/BA | St/BA |
| Polyester resin | | | | |
| Type: | (1) | — | (1) | (1) |
| Amount (pbw): | 10.0 | — | 10.0 | 10.0 |
| Weight-average molecular weight: | 10,000 | — | 10,000 | 10,000 |
| Negative charge control agent | | | | |
| Amount (pbw): | 0.8 | 0.8 | 0.8 | 0.8 |

TABLE 1-continued

| | | | | |
|---|---|---|---|---|
| Wax | | | | |
| Type: | Fischer = Tropsch | Fischer = Tropsch | Fischer = Tropsch | Fischer = Tropsch |
| Amount (pbw): | 15.0 | 15.0 | 15.0 | 15.0 |
| Melting point (° C.): | 78.0 | 78.0 | 78.0 | 78.0 |
| Endotherm (J/g): | 209.4 | 209.4 | 209.4 | 209.4 |
| Polymerization conditions | | | | |
| Temperature (° C.): | 70 | 70 | 70 | 70 |
| Retention time (h): | 6 | 6 | 6 | 6 |
| Temperature (° C.): | 80 | 80 | 80 | 80 |
| Retention time (h): | 4 | 4 | 4 | 4 |
| Toner: | (5-1) | (6-1) | (7-1) | (8-1) |
| Toner physical properties | | | | |
| Weight-average molecular weight: | 22,000 | 37,000 | 45,000 | 38,000 |
| Weight-average particle diameter (μm): | 6.5 | 6.4 | 6.4 | 6.2 |
| Average circularity: | 0.982 | 0.987 | 0.987 | 0.958 |
| Mode circularity: | 1.00 | 1.00 | 1.00 | 0.96 |
| Endothermic main peak temperature (° C.): | 70.1 | 70.2 | 70.2 | 70.2 |
| Endothermic main peak calorimetric integral value (J/g): | 19.2 | 19.5 | 19.5 | 19.7 |
| Glass transition point (° C.): | 58 | 58 | 58 | 58 |

| | Comparative Example | | | |
|---|---|---|---|---|
| | 1 | 2 | 3 | 4 |
| Toner particles: | 9 | 10 | 11 | 12 |
| Monomers | | | | |
| Styrene monomer | | | | |
| Amount (pbw): | — | — | — | 155.0 |
| n-Butyl acrylate | | | | |
| Amount (pbw): | — | — | — | 45.0 |
| Cross-linking agent | | | | |
| DVB | | | | |
| Amount (pbw): | — | — | — | — |
| Initiator(s) | | | | |
| 1,1,3,3-Tetramethylbutyl peroxy-2-ethylhexanoate | | | | |
| Amount (pbw): | — | — | — | 20.0 |
| t-Butyl peroxyneodecanoate | | | | |
| Amount (pbw): | — | — | — | — |
| Colorant | | | | |
| Copper phthalocyanine | | | | |
| Amount (pbw): | 13.0 | 13.0 | 13.0 | 13.0 |
| Magnetic iron oxide | | | | |
| Amount (pbw): | — | — | — | — |
| Resins | | | | |
| Styrene resin | | | | |
| Type: | (4) (5) | (6) (7) | (4) (8) | — |
| Amount (pbw): | 160.0 40.0 | 160.0 35.0 | 160.0 40.0 | — |
| Weight-average molecular weight: | 4,500 $29 \times 10^4$ | 11,000 $4 \times 10^5$ | 4,500 $9 \times 10^5$ | — |
| Glass transition point (° C.): | 59 64 | 63 64 | 59 67 | — |
| Type: | St St/BA | St/BA St/BA | St St/BA | — |
| Polyester resin | | | | |
| Type: | (1) | (1) | (1) | (1) |
| Amount (pbw): | 10.0 | 10.0 | 10.0 | 10.0 |
| Weight-average molecular weight: | 10,000 | 10,000 | 10,000 | 10,000 |
| Negative charge control agent | | | | |
| Amount (pbw): | 0.8 | 0.8 | 0.8 | 0.8 |
| Wax | | | | |
| Type: | Fischer = Tropsch | Fischer = Tropsch | Fischer = Tropsch | Fischer = Tropsch |
| Amount (pbw): | 15.0 | 15.0 | 15.0 | 15.0 |
| Melting point (° C.): | 78.0 | 78.0 | 78.0 | 78.0 |
| Endotherm (J/g): | 209.4 | 209.4 | 209.4 | 209.4 |

TABLE 1-continued

| | | | | |
|---|---|---|---|---|
| Polymerization conditions | | | | |
| Temperature (° C.): | — | — | — | 70 |
| Retention time (h): | — | — | — | 6 |
| Temperature (° C.): | — | — | — | 80 |
| Retention time (h): | — | — | — | 4 |
| Toner: | (9-1) | (10-1) | (11-1) | (12-1) |
| Toner physical properties | | | | |
| Weight-average molecular weight: | 70,000 | 70,000 | 180,000 | 62,000 |
| Weight-average particle diameter (μm): | 6.7 | 6.7 | 6.7 | 6.4 |
| Average circularity: | 0.957 | 0.957 | 0.961 | 0.974 |
| Mode circularity: | 0.96 | 0.96 | 0.96 | 1.00 |
| Endothermic main peak temperature (° C.): | 70.5 | 70.2 | 70.4 | 70.2 |
| Endothermic main peak calorimetric integral value (J/g): | 19.7 | 19.7 | 19.7 | 19.9 |
| Glass transition point (° C.): | 58 | 58 | 58 | 57 |

| | Comparative Example | | | Example | |
|---|---|---|---|---|---|
| | 5 | 6 | 7 | 9 | 10 |
| Toner particles: | 13 | 14 | 15 | 18 | 19 |
| Monomers | | | | | |
| Styrene monomer | | | | | |
| Amount (pbw): | 155.0 | 170.0 | 54.0 | 124.0 | 160.0 |
| n-Butyl acrylate | | | | | |
| Amount (pbw): | 45.0 | 30.0 | 16.0 | 36.0 | 40.0 |
| Cross-linking agent | | | | | |
| DVB | | | | | |
| Amount (pbw): | — | 0.01 | 0.02 | — | — |
| Initiator(s) | | | | | |
| 1,1,3,3-Tetramethylbutyl peroxy-2-ethylhexanoate | | | | | |
| Amount (pbw): | 40.0 | 8.0 | — | 8.0 | 15.0 |
| t-Butyl peroxyneodecanoate | | | | | |
| Amount (pbw): | — | — | — | — | 10.0 |
| Colorant | | | | | |
| Copper phthalocyanine | | | | | |
| Amount (pbw): | 13.0 | 10.0 | 10.0 | — | 13.0 |
| Magnetic iron oxide | | | | | |
| Amount (pbw): | — | — | — | 190.0 | — |
| Resins | | | | | |
| Styrene resin | | | | | |
| Type: | — | (9) | (10) | (1) | — |
| Amount (pbw): | — | 6.0 | 30.0 | 40.0 | — |
| Weight-average molecular weight: | — | 2,800 | 3,700 | 3,200 | — |
| Glass transition point (° C.): | — | 57 | 57 | 55 | — |
| Type: | — | St | St | St/BA | — |
| Polyester resin | | | | | |
| Type: | (1) | (1) | (1) | (1) | (1) |
| Amount (pbw): | 10.0 | 10.0 | 10.0 | 10.0 | 10.0 |
| Weight-average molecular weight: | 10,000 | 10,000 | 10,000 | 10,000 | 10,000 |
| Negative charge control agent | | | | | |
| Amount (pbw): | 0.8 | 0.8 | 4.0 | 0.8 | 0.8 |
| Wax | | | | | |
| Type: | Fischer = Tropsch | Behenyl stearate | Polypropyrene | Fischer = Tropsch | Fischer = Tropsch |
| Amount (pbw): | 15.0 | 15.0 | 6.0 | 15.0 | 15.0 |
| Melting point (° C.): | 78.0 | 66.0 | 83.8 | 78.0 | 78.0 |
| Endotherm (J/g): | 209.4 | 219.4 | 134.0/144.0 | 209.4 | 209.4 |
| Polymerization conditions | | | | | |
| Temperature (° C.): | 70 | 70 | 70 | 80 | 62 |
| Retention time (h): | 5 | 6 | 6 | 8 | 5 |
| Temperature (° C.): | 80 | 80 | 80 | — | 75 |
| Retention time (h): | 4 | 4 | 4 | — | 5 |
| Toner: | (13-1) | (14-1) | (15-1) | (18-1) | (19-1) |
| Toner physical properties | | | | | |
| Weight-average molecular weight: | 38,000 | 160,000 | 150,000 | 33,000 | 48,000 |
| Weight-average particle diameter (μm): | 6.5 | 7 | 8.5 | 6.1 | 6.4 |

TABLE 1-continued

| | | | | | |
|---|---|---|---|---|---|
| Average circularity: | 0.976 | 0.982 | 0.953 | 0.981 | 0.984 |
| Mode circularity: | 1.00 | 0.98 | 0.96 | 1.00 | 1.00 |
| Endothermic main peak temperature (° C.): | 70.3 | 68.0 | 142.0 | 69.8 | 70.3 |
| Endothermic main peak calorimetric integral value (J/g): | 19.2 | 21.2 | 2.7 | 12.1 | 19.4 |
| Glass transition point (° C.): | 54 | 58 | 58 | 59 | 61 |

TABLE 2

| | Styrene resin No.: | | | | | | | | | |
|---|---|---|---|---|---|---|---|---|---|---|
| | (1) | (2) | (3) | (4) | (5) | (6) | (7) | (8) | (9) | (10) |
| | Compositional ratio: | | | | | | | | | |
| Styrene monomer, amount (pbw): | 100.0 | 94.0 | 83.0 | 100.0 | 80.0 | 80.0 | 80.0 | 80.0 | 100.0 | 100.0 |
| n-Butyl acrylate, amount (pbw): | 0.1 | 6.0 | 17.0 | — | 20.0 | 20.0 | 20.0 | 20.0 | — | — |
| Di-tert-butyl peroxide, amount (pbw): | 13.0 | 13.0 | 5.0 | 10.0 | 2.0 | 8.0 | 1.5 | 1.0 | 15.0 | 12.0 |
| Cross-linking agent (DVB), amount (pbw): | — | — | — | — | — | — | — | 0.1 | — | — |
| Weight-average molecular weight (Mw): | 3,200 | 3,300 | 30,000 | 4,500 | 290,000 | 11,000 | 400,000 | 900,000 | 2,800 | 3,700 |
| Weight-average molecular weight (Mw)/number-average molecular weight (Mn): | 1.19 | 1.31 | 8.40 | 1.19 | 12.40 | 1.82 | 13.20 | 13.40 | 2.20 | 2.64 |
| Glass transition point (° C.): | 55 | 45 | 62 | 59 | 64 | 63 | 64 | 67 | 57 | 57 |

TABLE 3

| | Example | | | | | |
|---|---|---|---|---|---|---|
| | 1 | 2 | 3 | 4 | 5 | 6 |
| Toner: | (1-1) | (2-1) | (3-1) | (4-1) | (5-1) | (6-1) |
| H(4000): | 0.46 | 0.22 | 0.92 | 0.47 | 0.93 | 0.45 |
| H(15000): | 0.65 | 0.54 | 0.41 | 0.64 | 0.71 | 0.62 |
| H(M2): | 0.32 | 0.34 | 0.33 | 0 | 0.34 | 0.28 |
| H(M1): | 1 | 1 | 1 | 1 | 1 | 1 |
| H(L1): | 0.4 | — | 0.38 | 0.4 | 0.52 | 0.41 |
| H(M3): | 0.47 | — | 0.94 | 0.48 | 0.95 | 0.47 |
| M1: | 38,000 | 37,000 | 51,000 | 36,000 | 25,000 | 36,000 |
| M2: | 1,200 | 1,200 | 1,200 | — | 1,200 | 1,200 |
| M3: | 3,800 | — | 3,900 | 3,800 | 3,900 | 3,900 |
| S1: | 0.046 | 0.054 | 0.046 | 0.007 | 0.070 | 0.077 |
| S2: | 0.278 | 0.210 | 0.278 | 0.311 | 0.413 | 0.272 |
| S3: | 0.677 | 0.737 | 0.677 | 0.682 | 0.517 | 0.651 |
| S1/S2: | 0.164 | 0.256 | 0.164 | 0.022 | 0.170 | 0.282 |
| S3/S2: | 2.438 | 3.515 | 2.438 | 2.192 | 1.253 | 2.388 |

| | Example | | Comparative Example | | | |
|---|---|---|---|---|---|---|
| | 7 | 8 | 1 | 2 | 3 | 4 |
| Toner: | (7-1) | (8-1) | (9-1) | (10-1) | (11-1) | (12-1) |
| H(4000): | 0.12 | 0.46 | 4.2 | 2.8 | 5.2 | 0.07 |
| H(15000): | 0.52 | 0.63 | 3.6 | 3.8 | 4.1 | 0.64 |
| H(M2): | 0.31 | 0.31 | 0.92 | 0.97 | 0.93 | 0.3 |
| H(M1): | 1 | 1 | 0.1 | 0.1 | 0.1 | 1 |
| H(L1): | — | 0.42 | — | — | — | — |
| H(M3): | — | — | 4.5 | 5.1 | 5.4 | — |
| M1: | 37,000 | 38,000 | 280,000 | 390,000 | 870,000 | 38,000 |
| M2: | 1,200 | 1,200 | 1,200 | 1,200 | 1,200 | 1,200 |
| M3: | — | — | 5,100 | 12,000 | 5,100 | — |
| S1: | 0.055 | 0.046 | 0.071 | 0.045 | 0.072 | 0.057 |
| S2: | 0.190 | 0.276 | 0.705 | 0.630 | 0.670 | 0.351 |
| S3: | 0.755 | 0.679 | 0.224 | 0.325 | 0.258 | 0.592 |
| S1/S2: | 0.293 | 0.165 | 0.101 | 0.072 | 0.107 | 0.163 |
| S3/S2: | 3.984 | 2.461 | 0.318 | 0.515 | 0.386 | 1.684 |

TABLE 3-continued

| | Comparative Example | | | | | Example | |
|---|---|---|---|---|---|---|---|
| | 5 | 6 | 7 | 8 | 9 | 9 | 10 |
| Toner: | (13-1) | (14-1) | (15-1) | (16-1) | (17-1) | (18-1) | (19-1) |
| H(4000): | 0.22 | 0.12 | 0.5108 | 0.25 | 0.25 | 0.45 | 0.15 |
| H(15000): | 0.95 | 0.47 | 0.657 | 1 | 1 | 0.62 | 0.58 |
| H(M2): | 0.32 | 0.3002 | 0.0269 | 0 | 0 | 0.32 | 0.33 |
| H(M1): | 1 | 1 | 1 | 0.96 | 0.96 | 1 | 1 |
| H(L1): | — | — | — | — | — | 0.4 | 0.37 |
| H(M3): | — | — | — | — | — | 0.48 | 0.39 |
| M1: | 19,900 | 40,000 | — | 160,000 | 160,000 | 32,000 | 48,000 |
| M2: | 1,200 | 1,000 | — | — | — | 1,200 | 1,200 |
| M3: | — | — | — | — | — | 3,800 | 8,500 |
| S1: | 0.055 | 0.024 | 0.025 | 0.000 | 0.000 | 0.042 | 0.020 |
| S2: | 0.193 | 0.173 | 0.203 | 0.239 | 0.239 | 0.278 | 0.195 |
| S3: | 0.753 | 0.804 | 0.772 | 0.761 | 0.761 | 0.680 | 0.785 |
| S1/S2: | 0.284 | 0.136 | 0.122 | 0.000 | 0.000 | 0.153 | 0.102 |
| S3/S2: | 3.906 | 4.652 | 3.800 | 3.189 | 3.189 | 2.446 | 4.018 |

TABLE 4

| | | Image density | | | | | | Blocking resistance | | Fixing performance | | |
|---|---|---|---|---|---|---|---|---|---|---|---|---|
| | | L/L | | N/N | | H/H | | | | Fixable temp. range | Gloss max. | Gloss max. fixing temp |
| | | Initial stage | 8,000 sh. | Initial stage | 8,000 sh. | Initial stage | 8,000 sh. | 45° C. | 50° C. | (° C.) | (%) | (° C.) |
| Example: | | | | | | | | | | | | |
| 1 | Toner (1-1) | A | A | A | A | A | A | A | A | 125-225 | 40 | 175 |
| 2 | Toner (2-1) | A | A | A | A | A | B | A | A | 125-235 | 36 | 175 |
| 3 | Toner (3-1) | A | A | A | A | A | A | A | A | 125-210 | 31 | 175 |
| 4 | Toner (4-1) | B | B | A | A | A | A | A | A | 125-225 | 33 | 190 |
| 5 | Toner (5-1) | A | A | A | A | A | A | A | A | 125-200 | 30 | 165 |
| 6 | Toner (6-1) | B | C | B | B | B | C | A | A | 125-225 | 30 | 185 |
| 7 | Toner (7-1) | A | A | A | A | A | A | A | A | 135-240 | 30 | 190 |
| 8 | Toner (8-1) | B | B | B | B | B | C | A | A | 125-225 | 32 | 185 |
| Comparative Example: | | | | | | | | | | | | |
| 1 | Toner (9-1) | C | E | C | F | C | F | A | A | 130-205 | 25 | 180 |
| 2 | Toner (10-1) | C | E | C | E | C | E | A | A | 130-205 | 22 | 185 |
| 3 | Toner (11-1) | C | E | C | E | C | E | A | A | 130-210 | 18 | 190 |
| 4 | Toner (12-1) | A | A | A | A | A | A | A | A | 145-240 | 18 | 195 |
| 5 | Toner (13-1) | A | A | A | A | A | B | B | C | 145-230 | 23 | 185 |
| 6 | Toner (14-1) | A | A | A | A | A | A | A | A | 155-240 | 17 | 195 |
| 7 | Toner (15-1) | C | D | C | D | C | D | A | A | 150-240 | 17 | 195 |
| 8 | Toner (16-1) | D | F | D | F | F | F | A | A | 140-240 | 20 | 195 |
| 9 | Toner (17-1) | D | F | D | F | F | F | A | A | 140-240 | 19 | 195 |
| Example: | | | | | | | | | | | | |
| 9 | Toner (18-1) | A | A | A | A | A | A | A | A | 130-230 | 34 | 180 |
| 10 | Toner (19-1) | B | B | B | B | B | C | A | B | 140-240 | 30 | 190 |

TABLE 5

| | Comparative Example | |
|---|---|---|
| | 8 | 9 |
| Toner: | (16-1) | (17-1) |
| Toner physical properties | | |
| Weight-average molecular weight (Mw): | 69,500 | 69,500 |
| Weight-average particle diameter (μm): | 6.5 | 6.7 |
| Average circularity: | 0.972 | 0.973 |
| Mode circularity: | 0.96 | 0.97 |
| Endothermic main peak temperature (° C.): | 138.9 | 122.0 |

TABLE 5-continued

| | Comparative Example | |
|---|---|---|
| | 8 | 9 |
| Endothermic main peak calorimetric integral value (J/g): | 1.8 | 7.2 |
| Glass transition point (° C.): | 58 | 58 |

This application claims priority from Japanese Patent Application No. 2005-192196 filed on Jun. 30, 2005, which is hereby incorporated by reference herein.

The invention claimed is:

1. A toner comprising toner particles containing at least a binder resin, a colorant and a wax, wherein;

in a chart of molecular weight distribution measured by gel permeation chromatography of tetrahydrofuran-soluble matter of the toner;

i) the toner has a main peak in the region of molecular weight of from 16,000 to 60,000; and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) fulfill the following condition:

$$H(4000):H(15000):H(M1)=(0.10 \text{ to } 0.95):(0.20 \text{ to } 0.90):1.00;$$

the tetrahydrofuran-soluble matter of the toner has a weight-average molecular weight Mw of from 15,000 to 80,000 as measured by gel permeation chromatography; and in an endothermic chart as measured by differential scanning calorimetry;

i) the toner has an endothermic main peak in the range of from 40° C. to 130° C.; and ii) the calorimetric integral value represented by the peak area of the endothermic main peak is from 10 to 35 J per 1 g of the toner.

2. The toner according to claim 1, which, in the chart of molecular weight distribution measured by gel permeation chromatography of tetrahydrofuran-soluble matter of the toner, has a sub-peak in the region of molecular weight of from 600 to 2,000.

3. The toner according to claim 1, which, in the chart of molecular weight distribution measured by gel permeation chromatography of tetrahydrofuran-soluble matter of the toner, has at least a maximum point P(M3) in the region of molecular weight of from 2,500 or more to less than 15,000.

4. The toner according to claim 3, wherein, in the chart of molecular weight distribution measured by gel permeation chromatography of tetrahydrofuran-soluble matter of the toner, where the height at the maximum point P(M3) is represented by H(M3) and the minimum point present between the maximum point P(M3) and the main peak is represented by P(L1), and where the height at the minimum point P(L1) is represented by H(L1), the H(M3), the H(L1) and the H(M1) fulfill the following condition:

$$H(M3):H(L1):H(M1)=(0.10 \text{ to } 0.95):(0.20 \text{ to } 0.99):1.00.$$

5. The toner according to claim 1, wherein, in the chart of molecular weight distribution measured by gel permeation chromatography of tetrahydrofuran-soluble matter of the toner, the integral value S1 in the region of molecular weight of from 500 to 2,500 and the integral value S2 in the region of molecular weight of from 2,500 to 15,000 and the integral value S3 in the region of molecular weight of from 15,000 to 1,000,000 are in the ratio of S1:S2:S3=(0.15 to 0.95):1.00:(1.50 to 8.00).

6. The toner according claim 1, which has, in its particles of 3 μm or more in diameter, an average circularity of from 0.970 to 1.000 and a mode circularity of from 0.98 to 1.00.

7. The toner according to claim 1, wherein said toner particles are produced through at least a granulation step of dispersing a polymerizable monomer composition having at least a polymerizable monomer, a colorant, a wax and a low-molecular weight resin, in an aqueous medium to produce droplets of the polymerizable monomer composition, and a polymerization step of polymerizing the polymerizable monomer composition present in the droplets.

8. The toner according to claim 7, wherein said low-molecular weight resin has a tetrahydrofuran-soluble matter having a weight-average molecular weight of from 2,000 to 6,000 as measured by gel permeation chromatography.

9. The toner according to claim 7, wherein said low-molecular weight resin has a glass transition point of from 40° C. to 100° C.

10. A process for producing a toner; the process comprising producing toner particles through at least a granulation step of dispersing a polymerizable monomer composition having at least a polymerizable monomer, a colorant, a wax and a low-molecular weight resin, in an aqueous medium to produce droplets of the polymerizable monomer composition, and a polymerization step of polymerizing the polymerizable monomer composition present in the droplets;

said toner comprising toner particles containing at least a binder resin, the colorant and the wax, wherein;

in a chart of molecular weight distribution measured by gel permeation chromatography of tetrahydrofuran-soluble matter of the toner;

i) the toner has a main peak in the region of molecular weight of from 16,000 to 60,000; and ii) where the molecular weight at the main peak is represented by M1, and where the height at the molecular weight M1 is represented by H(M1), the height at a molecular weight of 4,000 by H(4000) and the height at a molecular weight of 15,000 by H(15000), the H(4000), the H(15000) and the H(M1) fulfill the following condition:

$$H(4000):H(15000):H(M1)=(0.10 \text{ to } 0.95):(0.20 \text{ to } 0.90):1.00;$$

the tetrahydrofuran-soluble matter of the toner has a weight-average molecular weight Mw of from 15,000 to 80,000 as measured by gel permeation chromatography; and in an endothermic chart as measured by differential scanning calorimetry;

i) the toner has an endothermic main peak in the range of from 40° C. to 130° C.; and ii) the calorimetric integral value represented by the peak area of the endothermic main peak is from 10 to 35 J per 1 g of the toner.

11. The process for producing a toner according to claim 10, wherein said low-molecular weight resin has a tetrahydrofuran-soluble matter having a weight-average molecular weight Mw of from 2,000 to 6,000 as measured by gel permeation chromatography.

12. The process for producing a toner according to claim 10, wherein said low-molecular weight resin has a glass transition point of from 40° C. to 100° C.

13. The process for producing a toner according to claim 10, wherein, in the chart of molecular weight distribution measured by gel permeation chromatography of tetrahydrofuran-soluble matter of the toner, said toner has a sub-peak in the region of molecular weight of from 600 to 2,000.

14. The process for producing a toner according to claim 10, wherein, in the chart of molecular weight distribution measured by gel permeation chromatography of tetrahydrofuran-soluble matter of the toner, said toner has at least a maximum point P(M3) in the region of molecular weight of from 2,500 or more to less than 15,000.

15. The process for producing a toner according to claim 14, wherein, in the chart of molecular weight distribution measured by gel permeation chromatography of tetrahydrofuran-soluble matter of the toner, said toner has the height at the maximum point P(M3) is represented by H(M3) and the minimum point present between the maximum point P(M3) and the main peak is represented by P(L1), and where the height at the minimum point P(L1) is represented by H(L1), the H(M3), the H(L1) and the H(M1) fulfill the following condition:

$$H(M3):H(L1):H(M1)=(0.10 \text{ to } 0.95):(0.20 \text{ to } 0.99):1.00.$$

16. The process for producing a toner according to claim 10, wherein, in the chart of molecular weight distribution measured by gel permeation chromatography of tetrahydrofuran-soluble matter of the toner, said toner has the integral value S1 in the region of molecular weight of from 500 to 2,500 and the integral value S2 in the region of molecular weight of from 2,500 to 15,000 and the integral value S3 in the region of molecular weight of from 15,000 to 1,000,000 are in the ratio of S1:S2:S3=(0.15 to 0.95):1.00:(1.50 to 8.00).

17. The process for producing a toner according to claim 10, wherein said toner has, in its particles of 3 μm or more in diameter, an average circularity of from 0.970 to 1.000 and a mode circularity of from 0.98 to 1.00.

* * * * *